US012442117B2

(12) United States Patent
Mori et al.

(10) Patent No.: US 12,442,117 B2
(45) Date of Patent: Oct. 14, 2025

(54) PRESSING DEVICE, SEWING MACHINE INCLUDING PRESSING DEVICE, AND METHOD FOR ATTACHING PRESSING DEVICE

(71) Applicant: BROTHER KOGYO KABUSHIKI KAISHA, Nagoya (JP)

(72) Inventors: Hiroki Mori, Nagoya (JP); Hiroshi Yamasaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 20 days.

(21) Appl. No.: 18/192,087

(22) Filed: Mar. 29, 2023

(65) Prior Publication Data

US 2023/0313429 A1 Oct. 5, 2023

(30) Foreign Application Priority Data

Mar. 31, 2022 (JP) ..... 2022-060529

(51) Int. Cl.
*D05B 29/02* (2006.01)
*D05B 29/08* (2006.01)
*D05B 29/12* (2006.01)

(52) U.S. Cl.
CPC ..... *D05B 29/02* (2013.01); *D05B 29/08* (2013.01); *D05B 29/12* (2013.01)

(58) Field of Classification Search
None
See application file for complete search history.

(56) References Cited

U.S. PATENT DOCUMENTS 2,611,333 A * 9/1952 Ritter ..... D05B 29/08 112/235
4,646,668 A * 3/1987 Biermann ..... D05B 29/08 112/311

(Continued)

FOREIGN PATENT DOCUMENTS

CN 109183288 A * 1/2019 ..... D05B 29/06
DE 1485178 A1 * 7/1969 ..... D05B 29/02

(Continued)

OTHER PUBLICATIONS

English translation of WO2008053558, obtained via patents.google.com (last visited Jun. 4, 2024). (Year: 2024).*

*Primary Examiner* — Patrick J. Lynch
(74) *Attorney, Agent, or Firm* — Oliff PLC

(57) ABSTRACT

A pressing device includes a first member including an attaching portion attachable to a presser bar and being configured to move in an up-down direction together with the presser bar urged downward; a second member including a contact portion contactable to a pressing portion including at least a portion of the first member or at least a portion of the presser bar and being configured to support a presser foot capable of downwardly pressing a workpiece on a bed, and in a state where the first member is attached to the presser bar and the second member supports the presser foot, move between a first position where the contact portion is in contact with the pressing portion and a second position where the contact portion is spaced from the pressing portion; and a first guide portion configured to guide movement of the second member relative to the first member.

17 Claims, 23 Drawing Sheets

(56) References Cited

U.S. PATENT DOCUMENTS

| | | | | | |
|---|---|---|---|---|---|
| 5,676,075 | A * | 10/1997 | Chen | ..... | D05B 29/12 112/240 |
| 2007/0204777 | A1 * | 9/2007 | Yamasaki | ..... | D05B 29/02 112/237 |
| 2009/0301369 | A1 * | 12/2009 | Kawaguchi | ..... | D05B 69/10 112/235 |
| 2017/0073865 | A1 * | 3/2017 | Kuramashi | ..... | D05B 29/06 |

FOREIGN PATENT DOCUMENTS

| | | | | | |
|---|---|---|---|---|---|
| GB | 375134 | A * | 6/1932 | ..... | D05B 29/08 |
| JP | H05-115641 | A | 5/1993 | | |
| JP | H11-019358 | A | 1/1999 | | |
| JP | 2001-187288 | A | 7/2001 | | |
| JP | 2019-130121 | A | 8/2019 | | |
| JP | 2019-162284 | A | 9/2019 | | |
| WO | WO-2008053558 | A1 * | 5/2008 | ..... | D05B 15/00 |

* cited by examiner

PRESSING DEVICE, SEWING MACHINE INCLUDING PRESSING DEVICE, AND METHOD FOR ATTACHING PRESSING DEVICE

REFERENCE TO RELATED APPLICATIONS

This application claims priority from Japanese Patent Application No. 2022-060529 filed on Mar. 31, 2022. The entire content of the priority application is incorporated herein by reference.

BACKGROUND ART

A known pressing device for a sewing machine includes a connecting member, a moving member, and an elastic member. The connecting member is connected to a shaft of the sewing machine and swings. The moving member moves up and down as the connecting member swings. The elastic member is disposed between the moving member and a presser bar, and changes an elastic force applied to the presser bar by the movement of the moving member. The pressing device changes an urging force applied to a presser foot disposed at a lower end of the presser bar in conjunction with the shaft of the sewing machine by moving the moving member such that the urging force of the elastic member is greater when the feed dog is located higher than a needle plate than that when the feed dog is located below the needle plate.

DESCRIPTION

The known pressing device for the sewing machine may have a complicated configuration for changing a pressing force applied to a workpiece by the presser foot.

Aspects of the disclosure provide a pressing device that may change a pressing force applied to a workpiece by a presser foot with a relatively simple configuration, a sewing machine including the pressing device, a method for attaching the pressing device.

In one aspect of the disclosure, a pressing device may include a first member, a second member, and a first guide portion. The first member may include an attaching portion attachable to a presser bar of a sewing machine. The first member may be configured to move in an up-down direction together with the presser bar being urged downward. The second member may include a contact portion being contactable to a pressing portion. The pressing portion may include at least a portion of the first member or at least a portion of the presser bar. The second member may be configured to support a presser foot capable of downwardly pressing a workpiece placed on a bed of the sewing machine. The second member may be further configured to, in a state where the first member is attached to the presser bar of the sewing machine and the second member supports the presser foot, move between a first position where the contact portion is in contact with the pressing portion; and a second position where the contact portion is spaced from the pressing portion. The first guide portion may be configured to guide movement of the second member relative to the first member. Thus, in the pressing device, the position of the second member relative to the first member may be changed in accordance with the position of the presser bar in the up-down direction. Such a pressing device may eliminate need for a complicated mechanism, for example, a connecting member such as a link mechanism in the sewing machine, and may change the pressing force applied to the workpiece by the presser foot with a simpler configuration than the known configuration.

In a further aspect of the disclosure, a sewing machine may include a machine motor, a needle bar, a needle plate, a presser bar, and the pressing device according to the one aspect. The needle bar may have a lower end to which a needle is attachable. The needle bar may be configured to move in an up-down direction in response to driving of the machine motor. The needle plate may have a needle hole through which the needle passes. The presser bar may be configured to move in the up-down direction in response to driving of the machine motor. The pressing device may be attachable to a lower end portion of the presser bar. Thus, in the sewing machine, the position of the second member relative to the first member may be changed in accordance with the position of the presser bar in the up-down direction. Such a sewing machine may eliminate need for a complicated mechanism, for example, a connecting member such as a link mechanism in the sewing machine, and may change the pressing force applied to the workpiece by the presser foot with a simpler configuration than the known configuration.

In a still further aspect of the disclosure, a method for attaching the pressing device according to the one aspect may include attaching the attaching portion of the first member to the presser bar of the sewing machine in a state where the second member is located at the first position. In the pressing device attached to the presser bar in accordance with the method according to the still further aspect, the position of the second member when the pressing device is attached to the presser bar may be adjusted to the first position.

In a yet further aspect of the disclosure, a method for attaching the pressing device according to the one aspect may include attaching the attaching portion of the first member to the presser bar of the sewing machine in a state where the second member is offset to the first position from a separated position where the contact portion is located farthest from the pressing portion in the up-down direction. In the pressing device attached to the presser bar in accordance with the method according to the yet further aspect, the position of the second member when the pressing device is attached to the presser bar may be adjusted to the position offset to the first position from the separated position.

Figure 1:
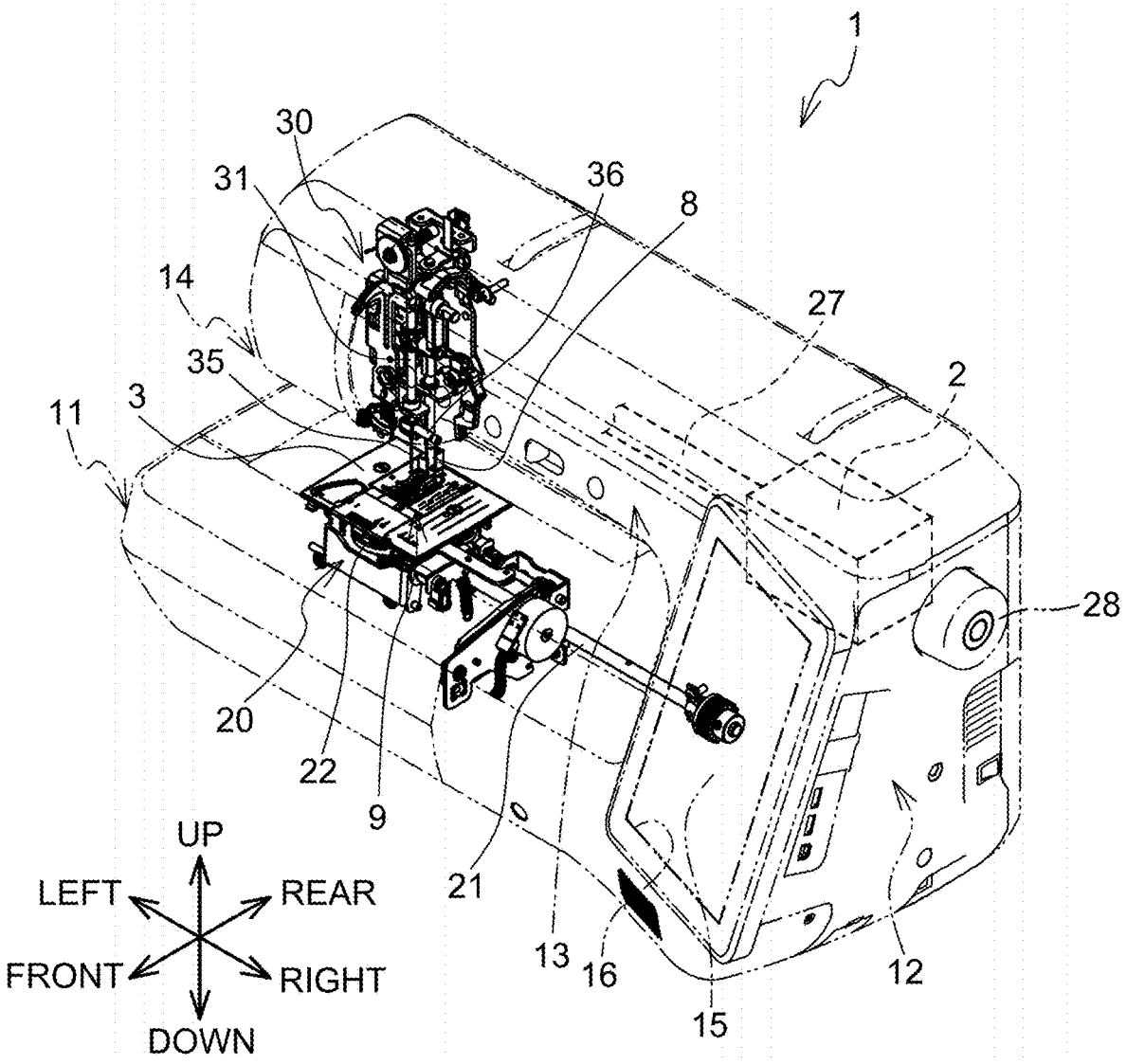
FIG. 1 is a perspective view of a sewing machine to which a pressing device is attached.

An illustrative embodiment will be described with reference to the accompanying drawings. Referring to FIG. 1, a description will be provided on a configuration of a sewing machine 1 to which a pressing device 9 is attached. In the page of FIG. 1, an upper side, a lower side, a lower left side, an upper right side, an upper left side, and a lower right side respectively correspond to an upper side, a lower side, a front side, a rear side, a left side, and a right side of the sewing machine 1 to which the pressing device 9 is attached. As illustrated in FIG. 1, the sewing machine 1 includes a bed 11, an upright arm 12, a horizontal arm 13, and a head 14. A longitudinal direction of the bed 11 and a longitudinal direction of the horizontal arm 13 correspond to a left-right direction of the sewing machine 1. A side of the sewing machine 1 on which the upright arm 12 is disposed is the right side. A direction in which the upright arm 12 is elongated is an up-down direction of the sewing machine 1.

The bed 11 is a base portion of the sewing machine 1, and extends in the left-right direction. The bed 11 includes a needle plate 3 at its upper surface. The bed 11 includes a shuttle mechanism 20 and a feed mechanism 23 below the needle plate 3. The shuttle mechanism 20 includes a shaft 21 and a horizontal shuttle 22. The horizontal shuttle 22 rotates in response to rotation of the shaft 21, thereby causing an upper thread to catch a lower thread below the needle plate 3. The feed mechanism 23 is configured to convey a workpiece C (refer to FIG. 8A) toward the rear or the front by driving a feed dog 19 (refer to FIG. 8A) in accordance with driving of a machine motor 2. The upright arm 12 extends upward from a right end portion of the bed 11. The machine motor 2 is disposed inside an upper portion of the upright arm 12. The upright arm 12 is provided with an LCD 15 at its front surface. The LCD 15 includes a touch screen 16 on its front surface. The upright arm 12 is provided with a pulley 28 at its right surface.

The horizontal arm 13 extends leftward from an upper end of the upright arm 12 and faces the bed 11. The head 14 is connected to a left end portion of the horizontal arm 13. The head 14 further includes a needle bar 31, a needle bar mechanism 30, and a presser bar 8. A needle clamp 36 is fixed to a lower end portion of the needle bar 31. The needle clamp 36 detachably fixes a needle 35 thereto. The needle 35 is attached to a lower end of the needle bar 31 via the needle clamp 36. The needle bar mechanism 30 includes the machine motor 2, a shaft 27, a link mechanism 33, and a needle bar clamp 32. The shaft 27 is configured to transmit power of the machine motor 2 to the needle bar 31 via the link mechanism 33 (refer to FIG. 2) and the needle bar clamp 32 (refer to FIG. 2) by rotating in response to driving of the machine motor 2. The needle bar clamp 32 is fixed to the needle bar 31. The needle bar mechanism 30 is configured to move the needle bar 31 in the up-down direction in response to driving of the machine motor 2. The shaft 27 is configured to rotate also in response to rotation of the pulley 28 performed by a user.

Figure 2:
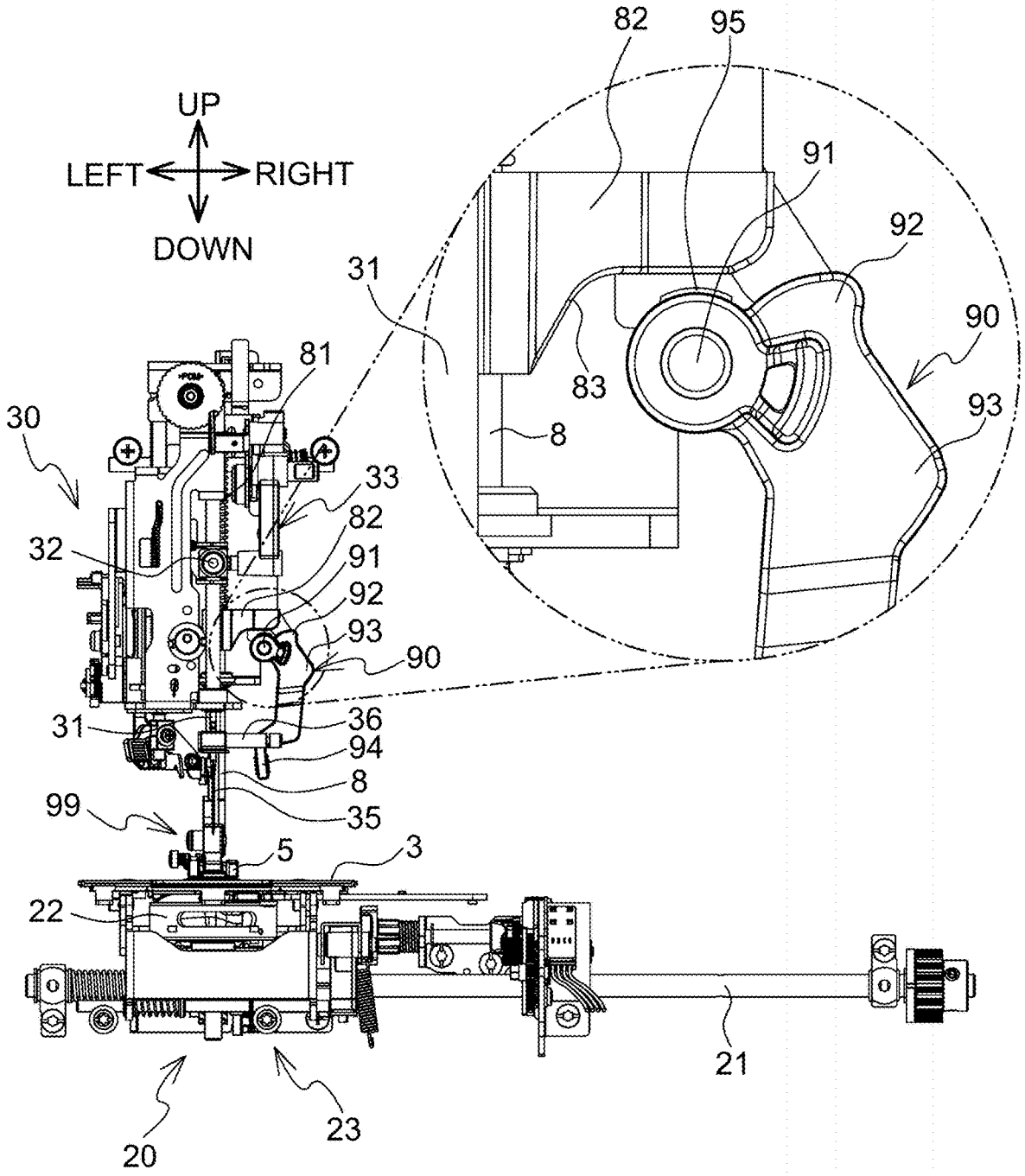
FIG. 2 is a front view of a shuttle mechanism and a needle bar mechanism 30 to which a known pressing device is attached to a lower end portion of a presser bar.

As illustrated in FIG. 2, the presser bar 8 extends in the up-down direction behind the needle bar 31. The presser bar 8 is configured to move in the up-down direction in response to driving of the machine motor 2. The presser bar 8 is provided with a pressing spring 81, a presser bar clamp 82, and a lever 90. The pressing spring 81 urges the presser bar 8 downward. The pressing spring 81 may be, for example, a coil spring disposed around the presser bar 8. The presser bar clamp 82 is fixed to the presser bar 8 and is in contact with a lower end of the pressing spring 81 to define a position of the lower end of the pressing spring 81.

The lever 90 enables a user to manually change a position of the presser bar 8 in the up-down direction. The lever 90 includes a shaft portion 91, projecting portions 92 and 93, a contact portion 95, and an operation portion 94. The shaft portion 91 is disposed inside the head 14. The projecting portions 92 and 93 are disposed in a vicinity of the shaft portion 91 and protrude in a direction away from the shaft portion 91. The contact portion 95 is a projecting portion that is disposed to the left of the projecting portion 92. The contact portion 95 extends along the shaft portion 91 and protrudes in a direction away from the shaft portion 91.

The operation portion 94 is disposed farthest from the shaft portion 91 among the shaft portion 91, the projecting portions 92 and 93, the contact portion 95, and the operation portion 94. The user is enabled to change the position of the presser bar 8 between an upper position and a lower position by operating the operation portion 94 with an operation body such as a finger to rotate the lever 90 clockwise or counterclockwise in plan view about the shaft portion 91. In FIG. 2, the operation portion 94 is located below the shaft portion 91 and the presser bar 8 is located at the lower position. When the presser bar 8 is located at the lower position, the contact portion 95 is located above the shaft portion 91. When the operation portion 94 is located below and diagonally to the right of the shaft portion 91 by counterclockwise rotation of the operation portion 94 in front view from the position of the operation portion 94 in FIG. 2, the projecting portion 92 of the lever 90 contacts a lower surface 83 of the presser bar clamp 82 to move the presser bar 8 to the upper position. When the presser bar 8 is located at the upper position, a particular portion of the lever 90 contacts the lower surface 83 of the presser bar clamp 82. The particular portion of the lever 90 is defined between the projecting portions 92 and 93. The workpiece C is placed on or removed from the bed 11 by the user while the presser bar 8 is located at the upper position.

Figure 3A:
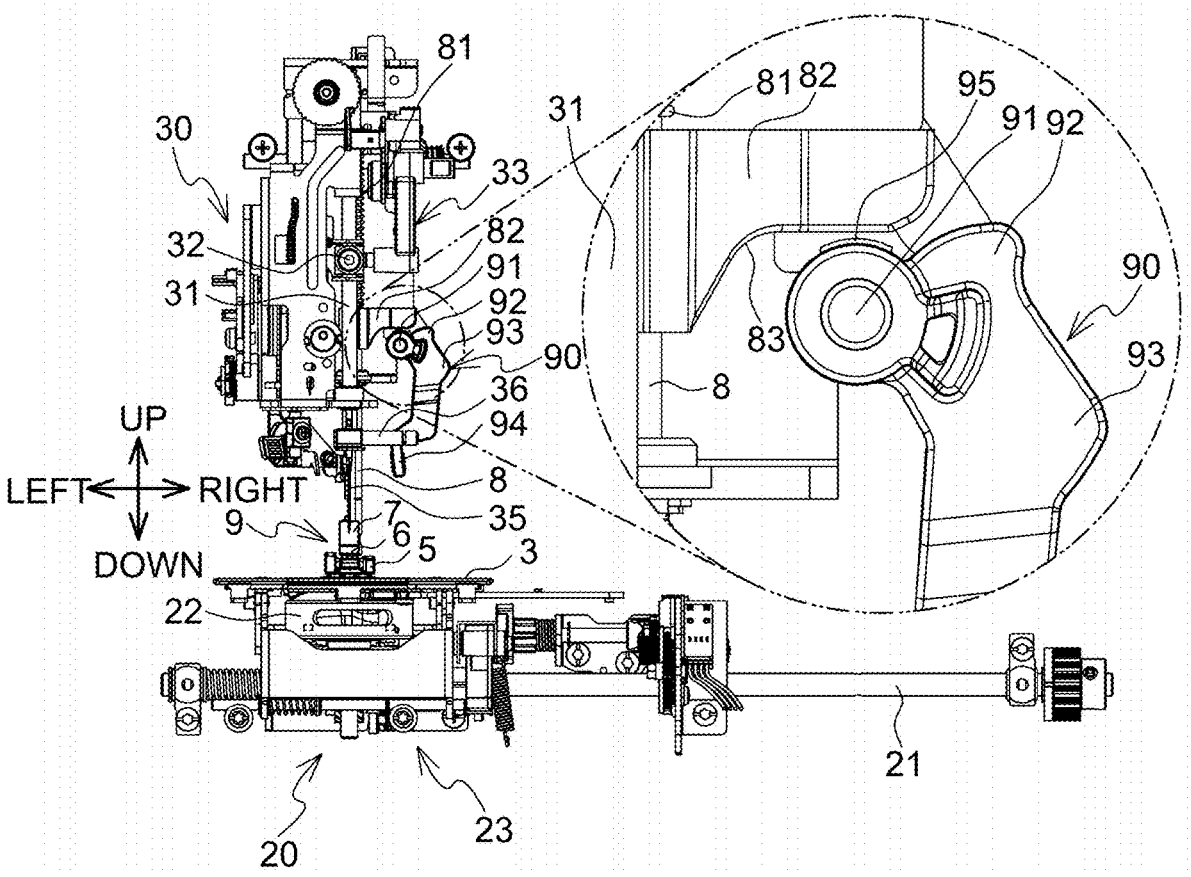
FIG. 3A is a front view of a pressing device when a second member to which a presser foot is attached is located at a first position.
Figure 3B:
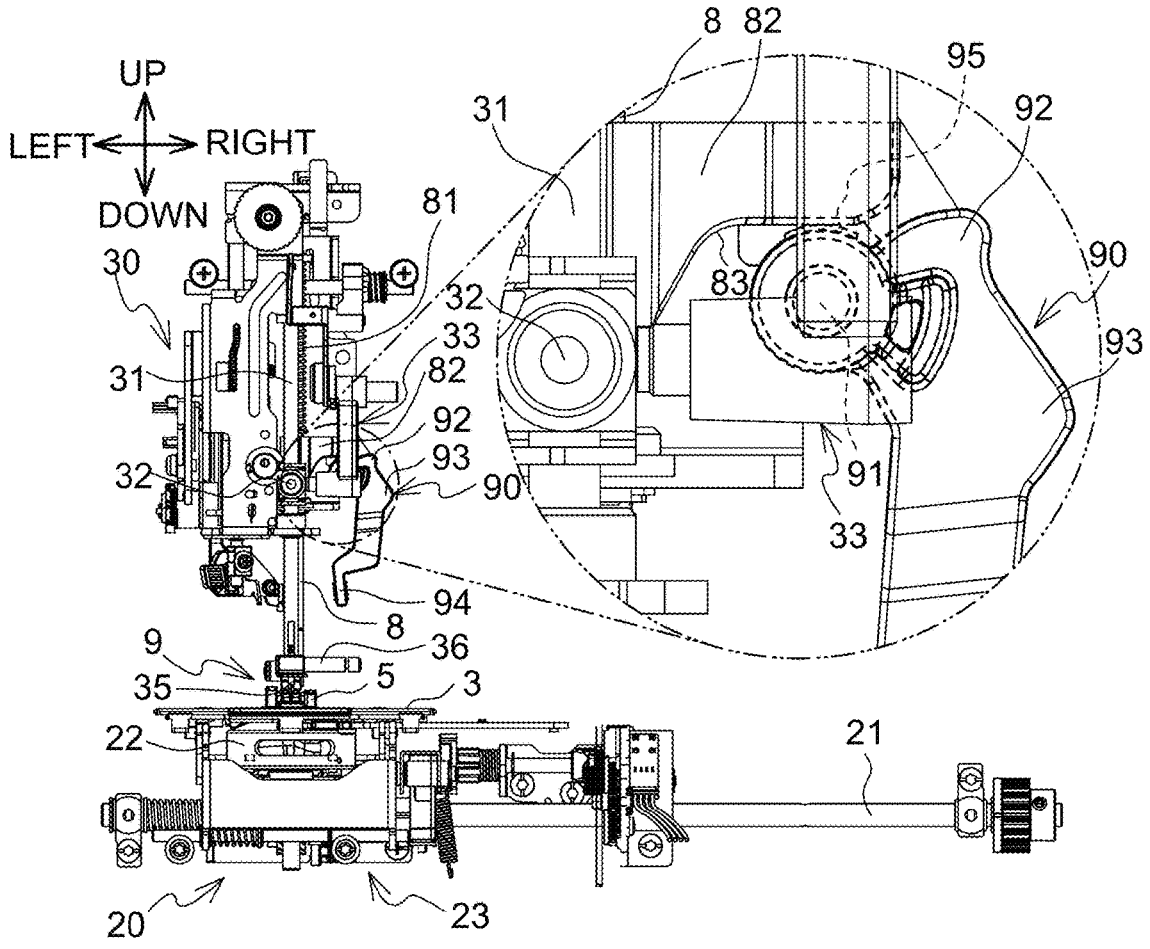
FIG. 3B is a front view of the pressing device when the second member to which the presser foot is attached is located at a second position.

The sewing machine 1 is configured such that a known pressing device 99 (refer to FIG. 2) or the pressing device 9 according to the illustrative embodiment (refer to FIG. 3) is detachably attachable to the lower end portion of the presser bar 8 selectively. Each of the pressing devices 99 and 9 is configured such that a presser foot 5 is detachably attached thereto. As illustrated in FIG. 2, in a case where the known pressing device 99 is attached to the presser bar 8 and the presser foot 5 is located at the lower position, the presser bar clamp 82 is spaced from the lever 90 in the up-down direction. Further, in this state, the presser foot 5 may contact the workpiece C placed on the needle plate 3 and presses the workpiece C downward. In a case where the known pressing device 99 is attached to the presser bar 8, the presser bar clamp 82 connected to the presser bar 8 of the sewing machine 1 does not contact the lever 90 of the sewing machine 1 while the needle bar 31 of the sewing machine 1 reciprocates once in the up-down direction. That is, in a case where the known pressing device 99 is attached to the presser bar 8 and the presser bar 8 is located at the lower position, the presser bar clamp 82 is spaced from the lever 90 and an urging force is always transmitted to the presser foot 5 from the pressing spring 81 while the needle bar 31 of the sewing machine 1 reciprocates once in the up-down direction.

Figure 4:
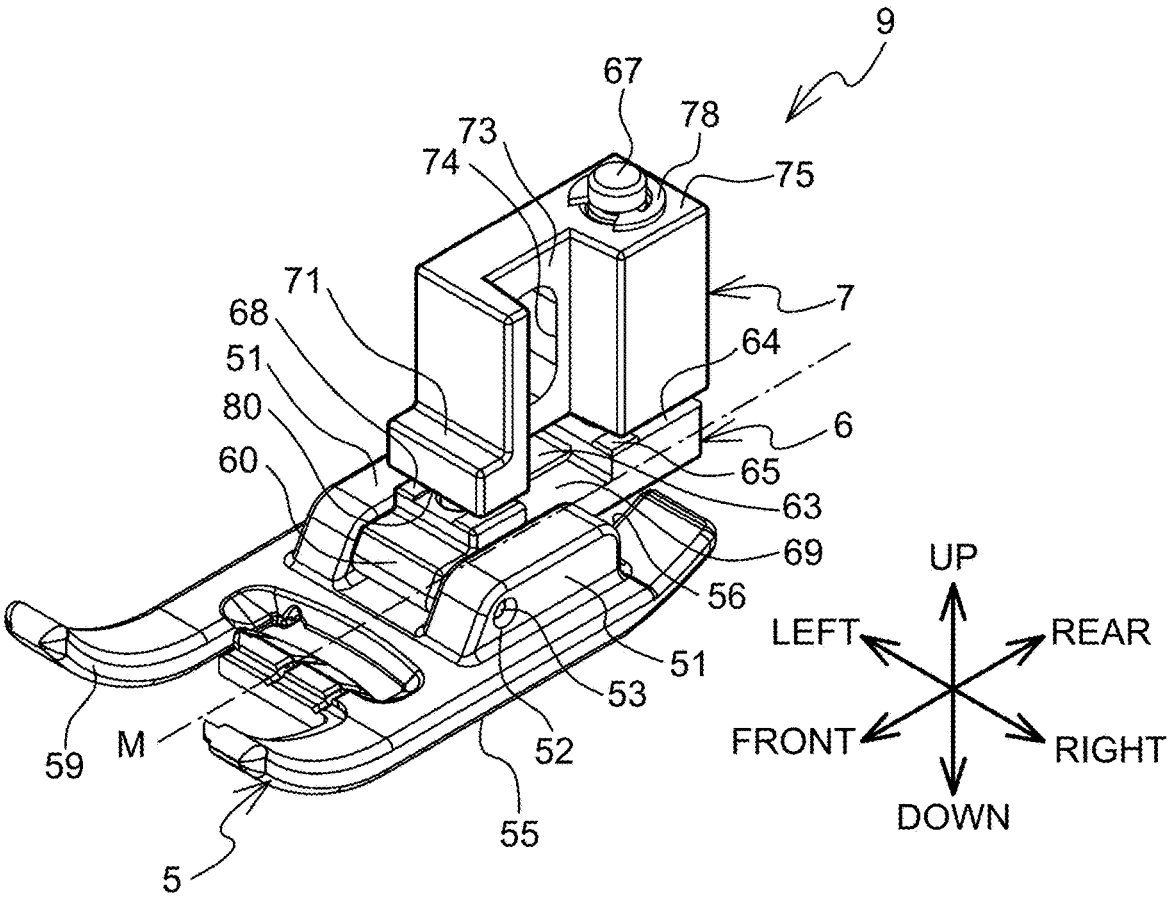
FIG. 4 is a perspective view of the pressing device to which the presser foot is attached.
Figure 5:
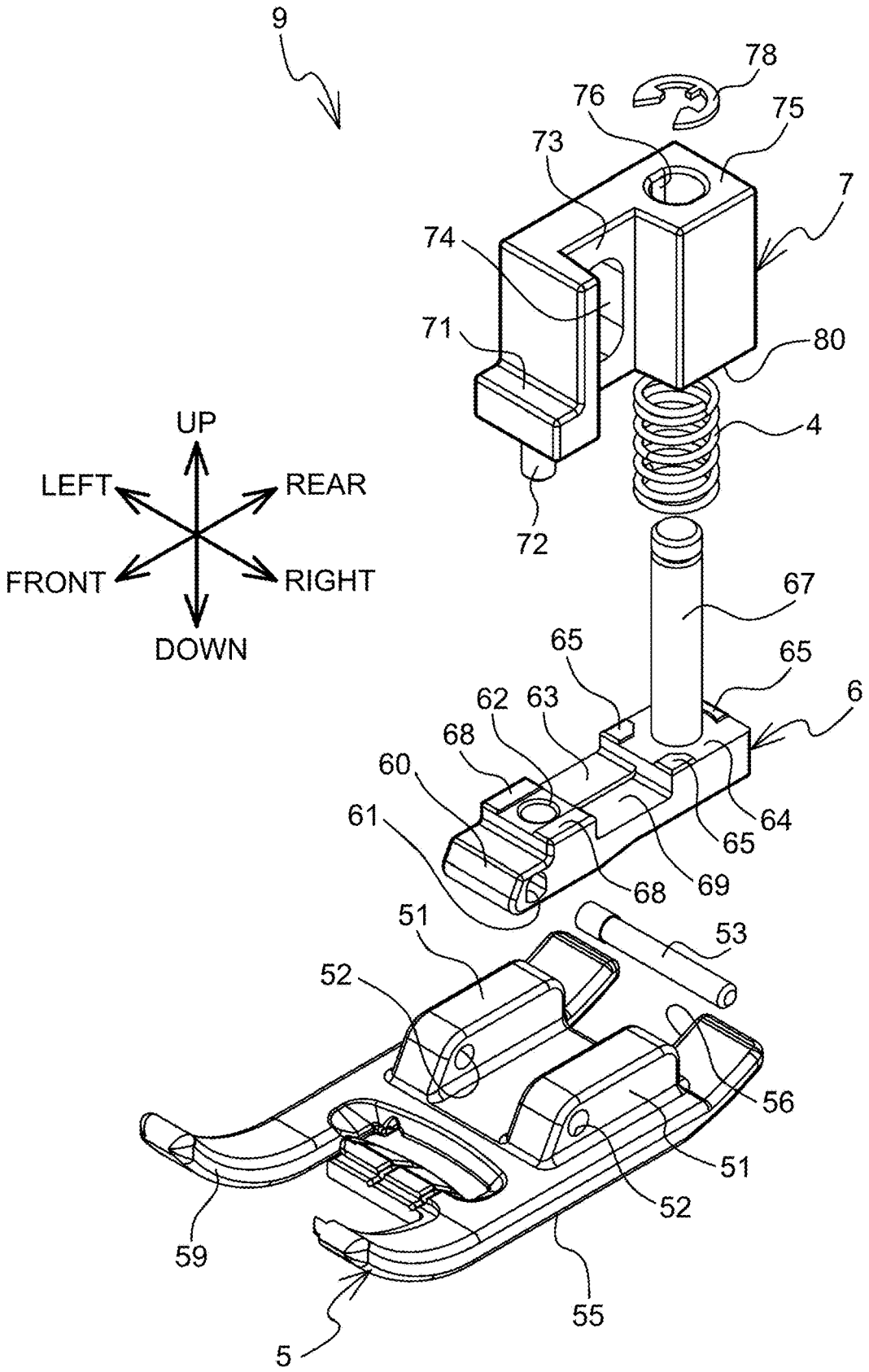
FIG. 5 is a disassembled perspective view of the presser foot and the pressing device.

As illustrated in FIGS. 4 and 5, the presser foot 5 has a rectangular plate shape having longer sides extending in the front-rear direction in plan view. The presser foot 5 has a front end portion and a rear end portion that are curved upward. The presser foot 5 has a cutout 59 in the front end portion. The presser foot 5 has a cutout 56 in the rear end portion. The cutout 59 has an R-shape in plan view. More specifically, the cutout 59 extends from a front end of the presser foot 5 toward the rear at a middle portion of the presser foot 5 in the left-right direction. A center line M passes through the middle portion of the presser foot 5. In response to the sewing machine 1 being driven in a state where one of the pressing device 9 and the pressing device 99 each supporting the presser foot 5 is attached to the lower end of the presser bar 8, the needle 35 passes through a rear end portion of the cutout 59. The cutout 56 has a rectangular shape in plan view. More specifically, the cutout 56 extends from a rear end of the presser foot 5 toward the front at the middle portion of the presser foot 5 in the left-right direction. The presser foot 5 includes a pair of shaft support portions 51 and a shaft 53 extending in the left-right direction. The shaft support portions 51 are disposed behind the cutout 59 and in front of the cutout 56. The shaft support portions 51 protrude upward from an upper surface of the presser foot 5. The shaft support portions 51 are spaced apart from each other in the left-right direction and extend in the front-rear direction. Each of the shaft support portions 51 has a hole 52 extending therethrough in the left-right direction. The shaft 53 is inserted into the holes 52 and supported by the shaft support portions 51.

The pressing device 9 according to the illustrative embodiment includes a first member 7, a second member 6, a guide portion 67, and a first urging member 4. The first member 7 includes an attaching portion 73 that is attached to the presser bar 8 of the sewing machine 1. The first member 7 is configured to, in a state where the pressing device 9 is attached to the presser bar 8, move in the up-down direction together with the presser bar 8 that is urged downward. The first member 7 includes a main body portion 75, a front portion 71, a guide portion 72, and a pressing portion 80. The main body portion 75 has a C shape in plan view. The main body portion 75 has a recessed portion that is recessed toward the left from a right surface of the main body portion 75. The recessed portion of the main body portion 75 serves as the attaching portion 73. The main body portion 75 has an elongated hole 74 in a left surface thereof The elongated hole 74 extends through the main body portion 75 in the left-right direction to communicate with the attaching portion 73. The elongated hole 74 has an elliptical shape elongated in the up-down direction. The main body portion 75 has an insertion portion 76 behind the attaching portion 73. The insertion portion 76 extends through the main body portion 75 in the up-down direction. The insertion portion 76 is an example of a third insertion portion. The front portion 71 protrudes toward the front from a lower front surface of the main body portion 75. The guide portion 72 has a cylindrical shape extending downward from a lower surface of the front portion 71. At least a portion of the first member 7 or at least a portion of the presser bar 8 may serve as the pressing portion 80. In the illustrative embodiment, a particular portion of the first member 7 may serve as the pressing portion 80. More specifically, for example, a lower surface of the front portion 71 and a lower surface of the main body portion 75 of the pressing device 9 may serve as the pressing portion 80.

The second member 6 supports the presser foot 5 that may press downward the workpiece C placed on the bed 11 of the sewing machine 1. The second member 6 may be a rectangular plate in plan view. The second member 6 includes a main body portion 64, recessed portions 63 and 69, the guide portion 67, three contact portions 65, two contact portions 68, and a front portion 60. The main body portion 64 has a rectangular plate shape having longer sides extending in the front-rear direction. The main body portion 64 of the second member 6 has a dimension in the up-down direction shorter than a dimension of the first member 7 in the up-down direction. The recessed portions 63 and 69 are recessed downward at a middle portion of the main body portion 64 in the front-rear direction. The recessed portion 69 is defined to the right of the recessed portion 63. An upper surface of the recessed portion 69 is lower than an upper surface of the recessed portion 63 in the up-down direction.

The guide portion 67 is disposed behind the recessed portions 63 and 69. The guide portion 67 has a cylindrical shape and extends upward from an upper surface of the main body portion 64. The guide portion 67 has a dimension in the up-down direction greater than a dimension of the main body portion 75 of the first member 7 in the up-down direction. The guide portion 67 is inserted into the insertion portion 76 of the first member 7 with the first urging member 4 being disposed around the guide portion 67. That is, the first urging member 4 is disposed outside the guide portion 67. The first urging member 4 may be, for example, a coil spring. The guide portion 67 inserted into the insertion portion 76 extends through the first member 7 in the up-down direction and protrudes from an upper end of the first member 7. A retaining ring 78 is attached to an upper end portion of the guide portion 67. The retaining ring 78 defines a movable range of the first member 7 in the up-down direction relative to the second member 6. The insertion portion 76 has a contact portion 79. An upper end of the first urging member 4 is in contact with the contact portion 79 of the insertion portion 76. A lower end of the first urging member 4 is in contact with the upper surface of the main body portion 64 of the second member 6. In a state where the first member 7 is attached to the presser bar 8 of the sewing machine 1, the first urging member 4 urges the second member 6 downward with an urging force less than a pressing force from the presser bar 8. The guide portion 67 guides movement of the second member 6 relative to the first member 7. The guide portion 67 has a rod-like shape and is fixed to the second member 6. The guide portion 67 is inserted into the insertion portion 76 of the first member 7, thereby limiting the movement of the second member 6 in a direction intersecting the up-down direction.

As illustrated in FIG. 5, the three contact portions 65 are disposed behind the recessed portions 63 and 69 and around the guide portion 67. The contact portions 65 may be projecting portions that protrude upward from the upper surface of the main body portion 64. One of the contact portions 65 is disposed in front of and to the right of the guide portion 67. Another of the contact portions 65 is disposed in front of and to the left of the guide portion 67. The other of the contact portions 65 is disposed behind the guide portion 67. The main body portion 64 has an insertion portion 62 in front of the recessed portions 63 and 69. The insertion portion 62 extends through the main body portion 64 in the up-down direction. The insertion portion 62 is an example of a fourth insertion portion. The guide portion 72 of the first member 7 is inserted into the insertion portion 62 from above. The guide portion 72 inserted into the insertion portion 62 does not protrude from a lower surface of the second member 6. In a state where the first member 7 is attached to the presser bar 8 of the sewing machine 1, the guide portion 72 and the guide portion 67 are located on opposite sides of the attaching portion 73 in the front-rear direction. The guide portion 72 is fixed to the first member 7. The guide portion 67 is fixed to the second member 6.

One of the contact portions 68 is disposed in front of the recessed portions 63 and 69 and to the right of the insertion portion 62. The other of the contact portions 68 is disposed in front of the recessed portions 63 and 69 and to the left of the insertion portion 62. The contact portions 68 may be projecting portions that protrude upward from the upper surface of the main body portion 64. Upper ends of the three contact portions 65 and upper ends of the two contact portions 68 are flush with each other in the up-down direction. The front portion 60 protrudes toward the front from a front surface of the main body portion 64. The front portion 60 has a hole 61 extending therethrough in the left-right direction. In a state where the presser foot 5 is attached to the second member 6, the second member 6 is placed between the shaft support portions 51 of the presser foot 5 in the left-right direction and the shaft 53 is inserted through the hole 61. The presser foot 5 is thus supported by the second member 6 so as to be swingable about the shaft 53.

Figure 6A:
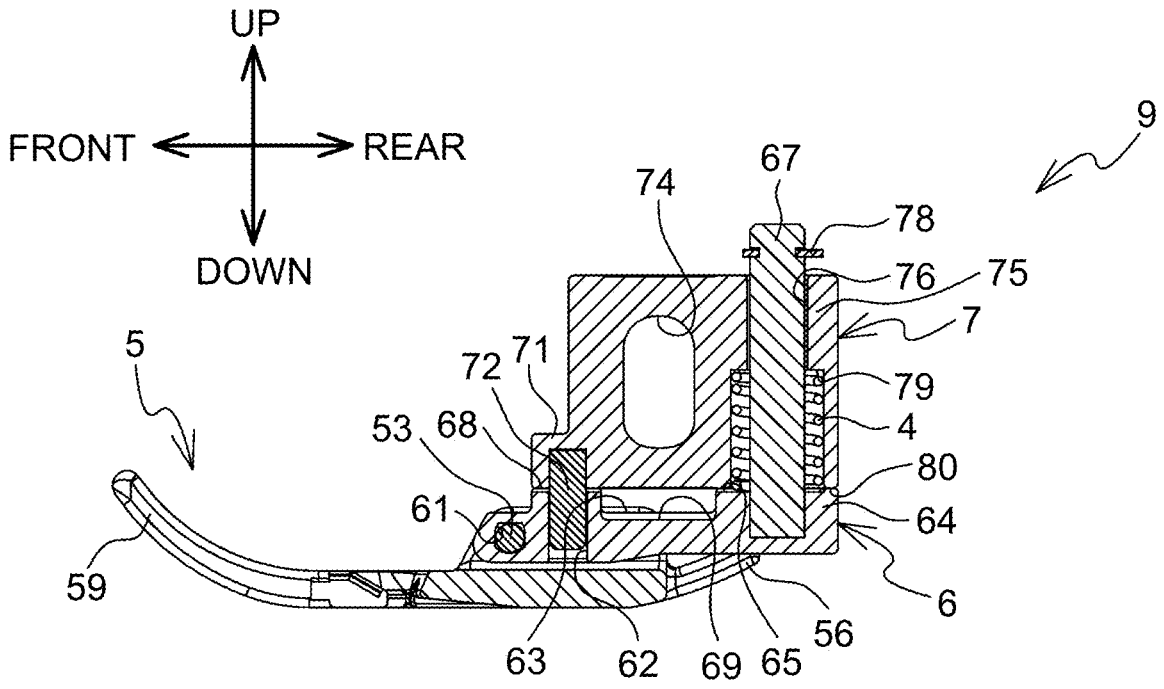
FIG. 6A is a sectional view of the pressing device when the second member of the pressing device to which the presser foot is attached is located at the first position.
Figure 6B:
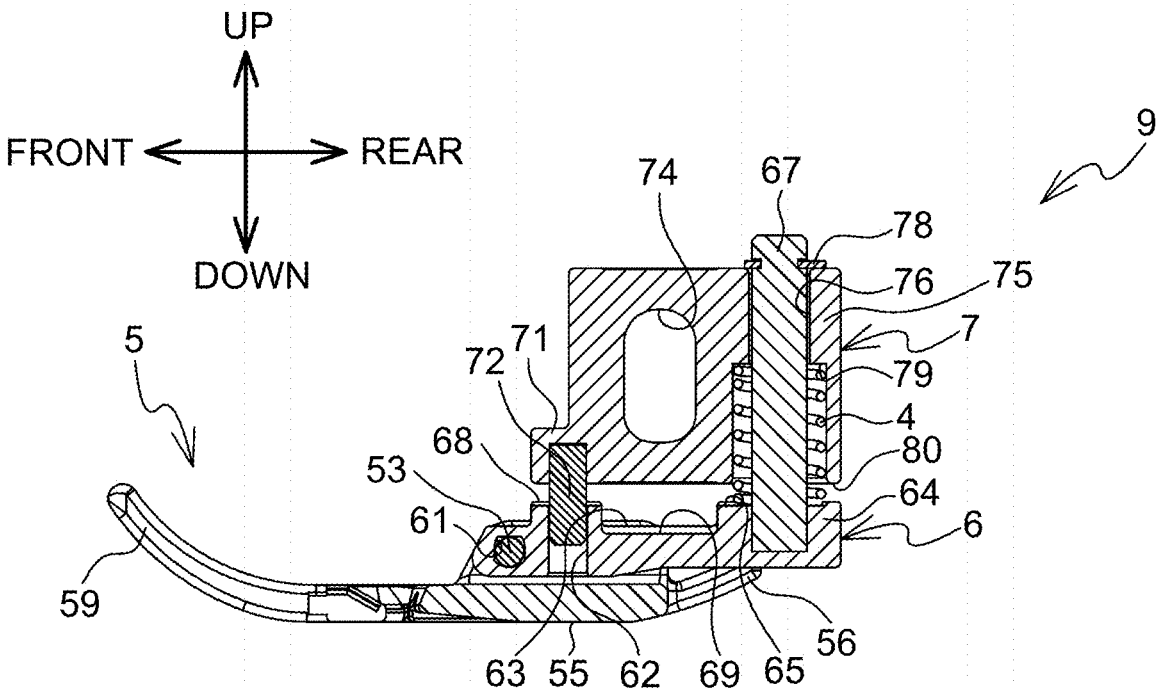
FIG. 6B is a sectional view of the pressing device when the second member of the pressing device to which the presser foot is attached is located at the second position (a separated position).

In a case where the first member 7 is attached to the presser bar 8 of the sewing machine 1 and the second member 6 supports the presser foot 5, the second member 6 is movable between a first position (refer to FIG. 6A) and a second position (refer to FIG. 6B). As illustrated in FIG. 6A, when the second member 6 is located at the first position, the contact portions 65 and 68 of the second member 6 are in contact with the pressing portion 80. As illustrated in FIG. 6B, when the second member 6 is located at the second position, the contact portions 65 and 68 of the second member 6 are spaced from the pressing portion 80. The second position (refer to FIG. 6B) also refers to a separated position of the second member 6 where the contact portions 65 and 68 of the second member 6 are located farthest from the pressing portion 80 in the up-down direction. In other words, when the second member 6 is located at the separated position, the contact portions 65 and 68 and the pressing portion 80 are separated from each other at a maximum distance.

Figure 7:
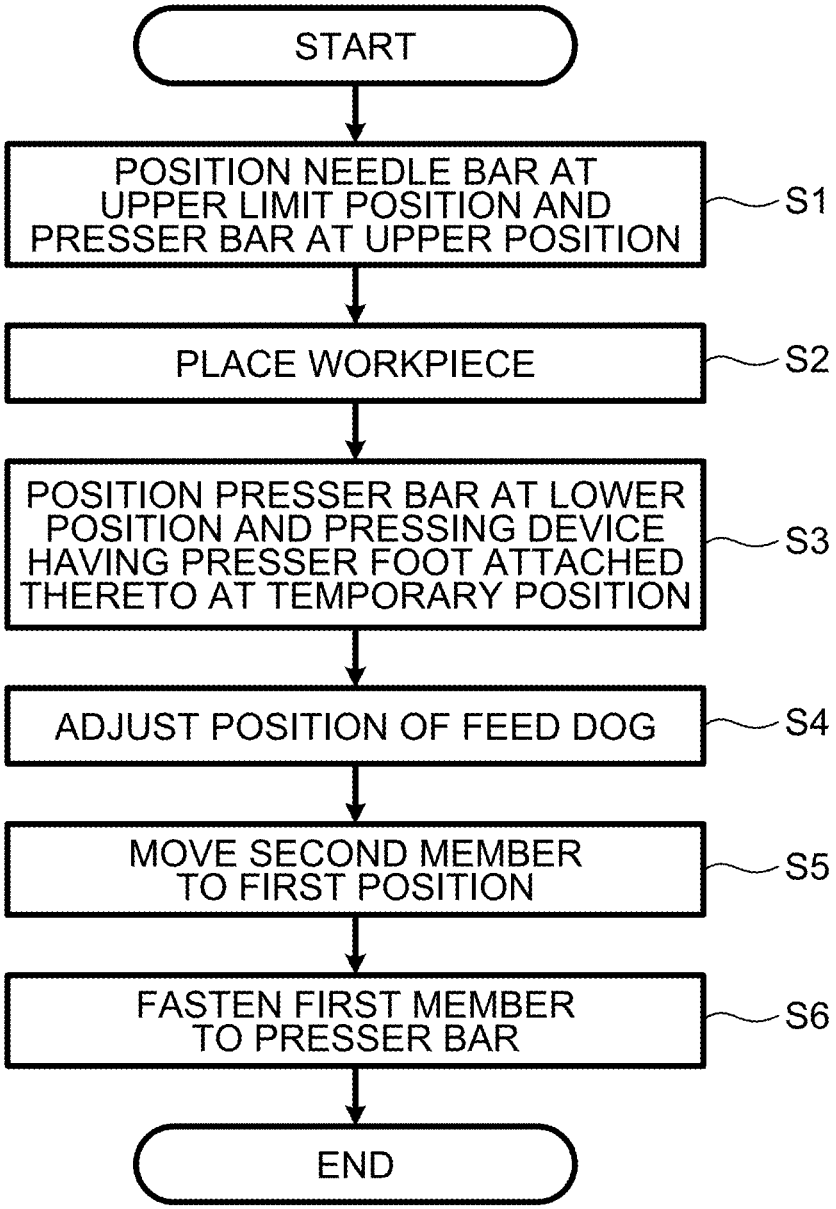
FIG. 7 is a flowchart illustrating a procedure for attaching the pressing device.

Referring to FIG. 7, a description will be provided on a procedure of attaching the pressing device 9 to the presser bar 8. The pressing device 9 is attached to the presser bar 8 such that contacting of the presser bar clamp 82 to the contact portion 95 of the lever 90 and separation of the presser bar clamp 82 from the contact portion 95 of the lever 90 both occur in a period during which an upper end of the feed dog 19 is located above the upper surface of the needle plate 3. Specifically, for example, the user operates the lever 90 to move the presser bar clamp 82 upward by the projecting portion 92 of the lever 90, thereby positioning the presser bar 8 at the upper position. The user then operates the pulley 28 to position the needle bar 31 in the vicinity of an upper limit position that may be an upper limit of a swingable range of the needle bar 31 in the up-down direction (S1). When the needle bar 31 is located in the vicinity of the upper limit position, the needle 35 is located above the needle plate 3. Subsequent to S1, the user places the workpiece C between the upper surface of the needle plate 3 and the needle 35 (S2). Subsequent to S2, the user operates the lever 90 to position the presser bar 8 at the lower position and the pressing device 9 having the presser foot 5 attached thereto at a temporary position relative to the presser bar 8 (S3). Specifically, for example, the user temporarily fixes the pressing device 9 to the lower end portion of the presser bar 8 in such a manner that the user positions the lower end portion of the presser bar 8 at the attaching portion 73 of the first member 7 and then inserts a screw 41 (refer to FIG. 8A) into the elongated hole 74 of the first member 7 and a threaded hole 84 (refer to FIG. 8A) of the presser bar 8. The second member 6 has the recessed portion 69. The user may thus adjust the position of the lower end portion of the presser bar 8 to a position lower than the lower end of the second member 6 and where the lower end of the presser bar 8 does not contact the second member 6. The screw 41 is an example of a fastening member.

Subsequent to S3, the user adjusts the upper end of the feed dog 19 to a certain position (S4). The certain position may any position as long as the attaching condition of the pressing device 9 is taken into consideration. In the illustrative embodiment, the user attaches the pressing device 9 to the presser bar 8 while the second member 6 is located at the first position or a position close to the first position against the urging force of the first urging member 4. The position shifted toward the first position is offset to the first position from the separated position, that is, lower than the separated position. The distance between the contact portions 65 and 68 and the pressing portion 80 when the second member 6 is located at the position shifted toward the first position is less than that when the second member 6 is located at the separated position. Thus, a position other than the upper limit of the movable range of the feed dog 19 is specified as the certain position. Any position of the upper end of the feed dog 19 in a period P2 (refer to FIG. 9) or a position of the upper end of the feed dog 19 at a boundary between the period P1 (refer to FIG. 9) and the period P2 is specified as the certain position for the upper end the feed dog 19 in S4. That is, when the upper end of the feed dog 19 is located at the certain position in S4, the presser bar clamp 82 and the contact portion 95 of the lever 90 are in contact with each other in the up-down direction. In S4, in one example, the user may operate the pulley 28 to adjust the position of the feed dog 19 manually. In another example, the user may operate the touch screen 16 to adjust the position of the feed dog 19 automatically. More specifically, the user may to enter an instruction to move the feed dog 19 to the certain position through the touch screen 16. In response to this, the sewing machine 1 may drive the machine motor 2 based on the instruction to change the position of the feed dog 19. In a further example, in a case where the sewing machine 1 has a feed dog dropping function that only the feed dog 19 is lowered to below the needle plate 3 independently of the movement of the needle bar 31, the user may enter an instruction to move the feed dog 19 to the certain position using the feed dog dropping function through the touch screen 16. In response to this, the sewing machine 1 may control power of a feed dog dropping mechanism based on the instruction to change the position of the feed dog 19 by the feed dog dropping mechanism. Subsequent to S4, the user moves the second member 6 to the first position (S5). More specifically, the user moves the first member 7 toward the second member 6 against the urging force of the first urging member 4 while maintaining the state in which the presser foot 5 is in contact with the workpiece C, thereby positioning the pressing portion 80 at a position where the pressing portion 80 is in contact with the contact portions 65 and 68 of the second member 6 or at a position where the pressing portion 80 is slightly spaced from the contact portions 65 and 68 of the second member 6. Subsequent to S5, in a state where the second member 6 is located at the first position, the user fastens the first member 7 of the pressing device 9 to the lower end portion of the presser bar 8 using the screw 41 through the threaded hole 84 of the presser bar 8 (S6). Upon completion of S6, the user completes the procedure of attaching the pressing device 9 to the presser bar 8.

Figure 8A:
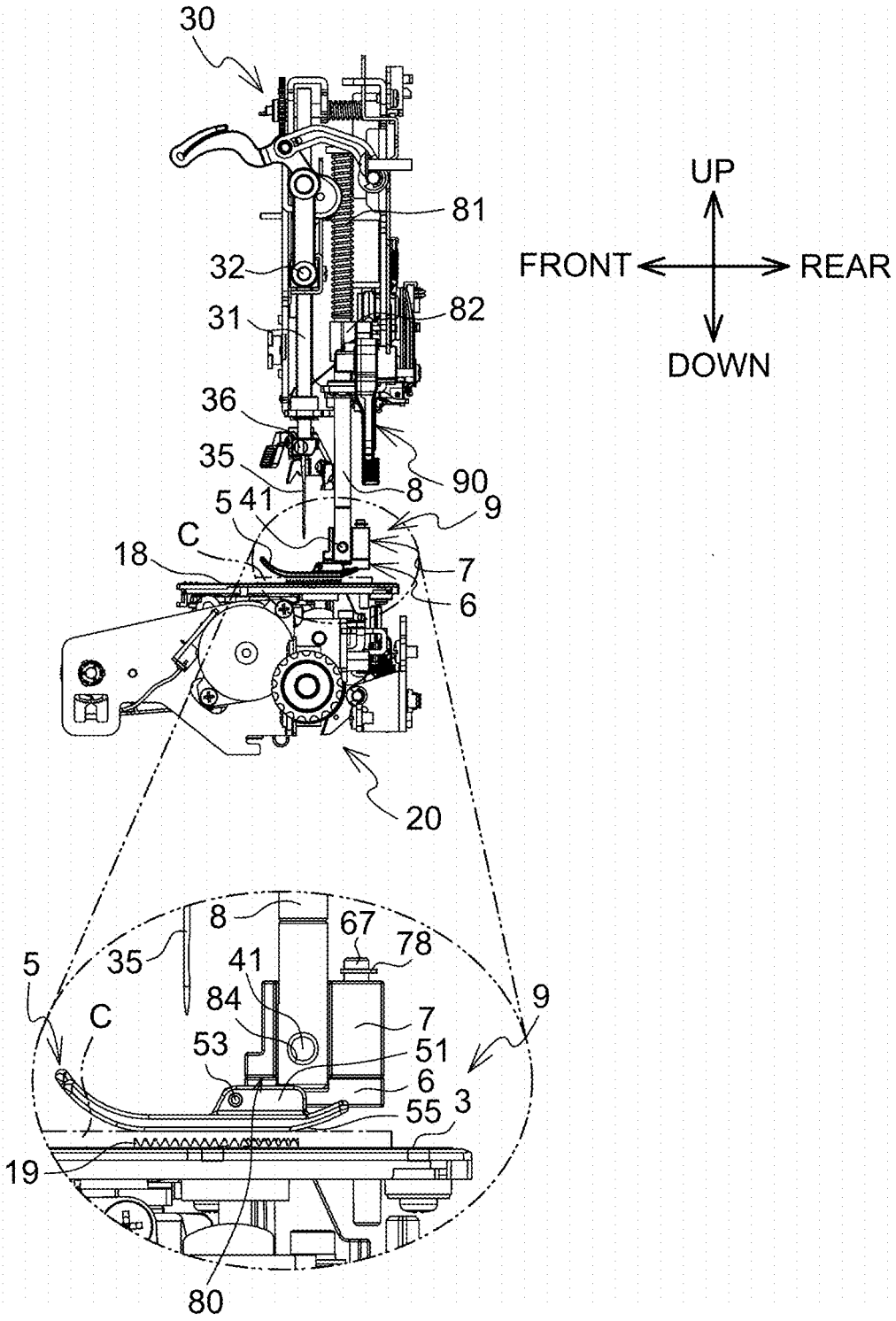
FIG. 8A is a right side view of the pressing device in which the second member is at the first position in accordance with an up-down position of the presser bar.
Figure 9:
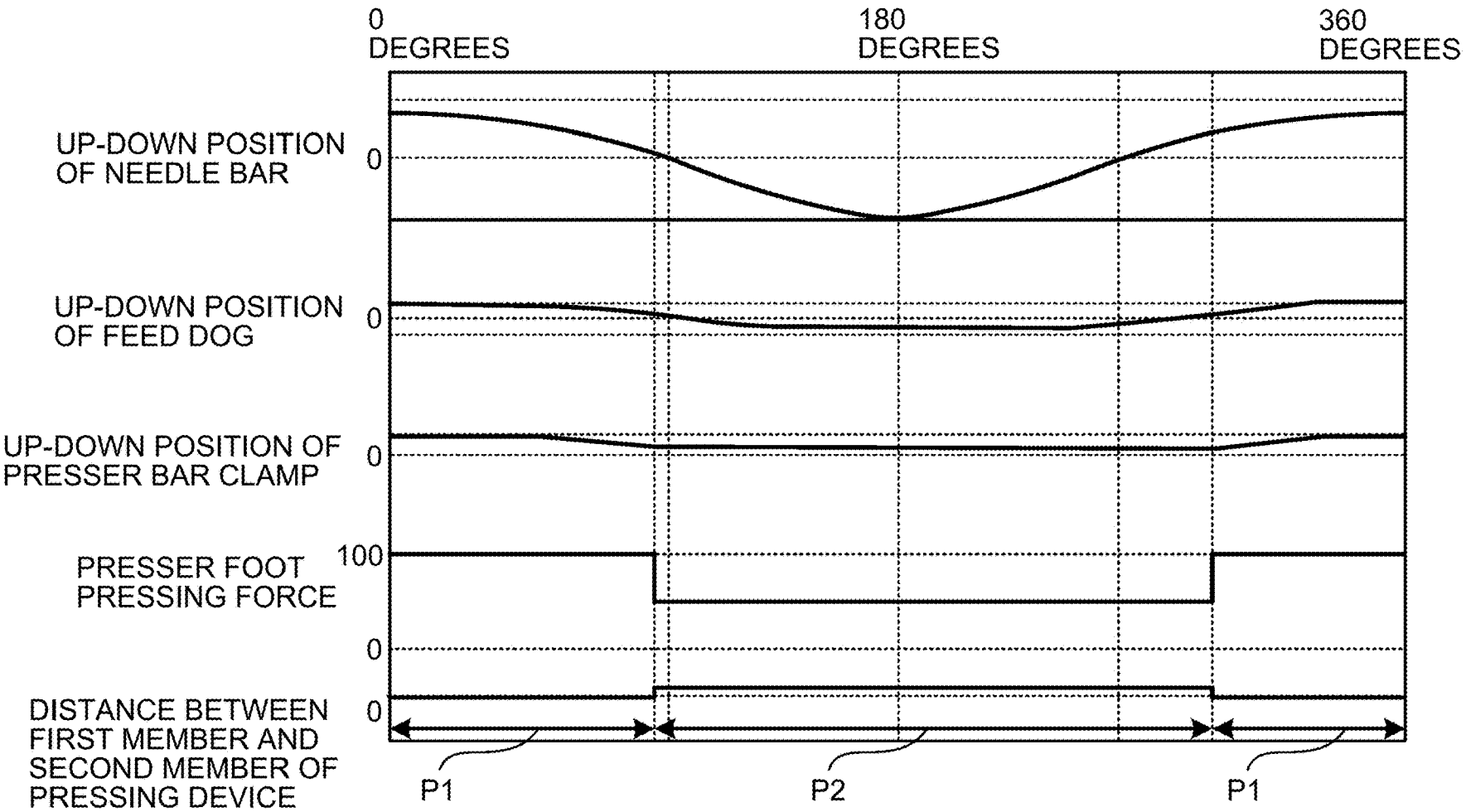
FIG. 9 is an explanatory diagram illustrating an up-down position of a needle bar, an up-down position of a feed dog, an up-down of a presser bar clamp, a pressing force applied to a workpiece by the presser foot, and a distance between a pressing portion of a first member and contact portions of the second member in an up-down direction in accordance with a rotation angle of a machine motor.

The up-down position of the presser bar clamp 82 and the up-down position of the presser bar 8 are changed in accordance with to the up-down position of the feed dog 19. In accordance with the above-described procedure, the pressing device 9 according to the illustrative embodiment is attached to a particular position of the presser bar 8 in the up-down direction. The particular position may be where the lower limit of the movable range of the presser bar 8 is defined by the lever 90 when the lower surface 83 of the presser bar clamp 82 contacts the contact portion 95 of the lever 90 while the needle bar 31 of the sewing machine 1 reciprocates once in the up-down direction. That is, in the pressing device 9 attached to the presser bar 8 in accordance with the above-described procedure, the presser bar clamp 82 is in contact with or is spaced from the contact portion 95 of the lever 90 in accordance with to the position of the upper end of the feed dog 19. As illustrated in FIG. 8A, when the lower end of the needle 35 is located above the needle plate 3, the second member 6 is located at the first position. When the lower end of the needle 35 is located above the needle plate 3, the presser bar clamp 82 is separated from the contact portion 95 of the lever 90 since the presser bar 8 is raised by the feed dog 19 whose upper end is located above the needle plate 3, via the presser foot 5 and the pressing device 9. In the illustrative embodiment, as illustrated in FIG. 9, a period during which the lower end of the needle 35 is located above the needle plate 3 refers to a period P1. When the second member 6 is located at the first position, the second member 6 transmits, to the presser foot 5, a downward pressing force received from the presser bar 8 via the pressing portion 80.

Figure 8B:
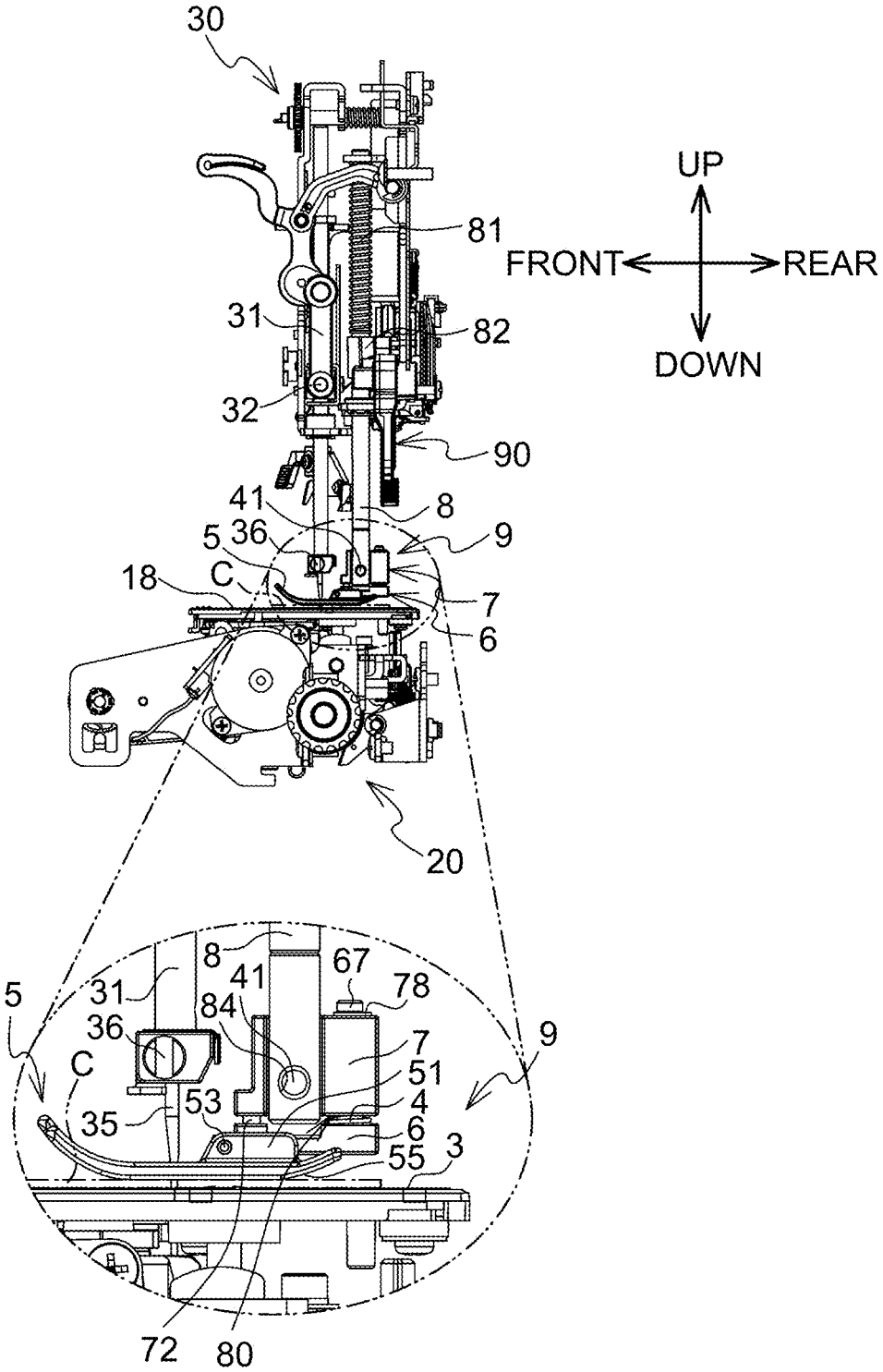
FIG. 8B is a right side view of the pressing device in which the second member is at the second position in accordance with the up-down position of the presser bar.

As illustrated in FIG. 8B, when the lower end of the needle 35 is located below the needle plate 3, the second member 6 is located at the second position. When the second member 6 is located at the second position, the second member 6 does not transmit the pressing force received from the presser bar 8 to the presser foot 5. When the lower end of the needle 35 is located below the needle plate 3, the upper end of the feed dog 19 is located below the upper surface of the needle plate 3. Thus, the presser bar 8 is not raised by the feed dog 19. Thus, the presser bar 8 is located at the lower position (e.g., the position of the presser bar 8 in S3), that is, at the position where the lower surface 83 of the presser bar clamp 82 is in contact with the contact portion 95 of the lever 90. Therefore, the presser bar 8 is not lowered further regardless of the up-down position of the needle bar 31. In this state, as illustrated in FIG. 9, the urging force of the pressing spring 81 is applied to the lever 90 and is not applied to the presser foot 5 via the pressing device 9. In FIG. 9, assuming that the pressing force applied to the presser foot 5 in the period P1 is 100, the pressing force applied to the presser foot 5 in the period P2 is indicated. The pressing force applied to the presser foot 5 in the period P2 is less than the pressing force applied to the presser foot 5 in the period P1. The second member 6 is lowered to a position where the presser foot 5 is in contact with the workpiece C by the urging force of the first urging member 4 while the feed dog 19 moves from the position where the lower surface 83 of the presser bar clamp 82 is in contact with the contact portion 95 of the lever 90 to the position where the upper end of the feed dog 19 is located below the needle plate 3. Thus, the pressing portion 80 of the first member 7 and the contact portions 65 and 68 of the second member 6 are separated from each other in the up-down direction. In a state where the first member 7 is attached to the presser bar 8 of the sewing machine 1 and the second member 6 is located at the second position, the second member 6 transmits the urging force of the first urging member 4 to the presser foot 5. As described above, in a state where the first member 7 is attached to the presser bar 8 of the sewing machine 1 and the second member 6 supports the presser foot 5, the second member 6 is located at the second position while the presser bar clamp 82 is in contact with the contact portion 95 of the lever 90, and the second member 6 is located at the first position while the presser bar clamp 82 is spaced from the contact portion 95 of the lever 90. That is, the position of the second member 6 is changed in accordance with the up-down position of the upper end of the feed dog 19.

Figure 10:
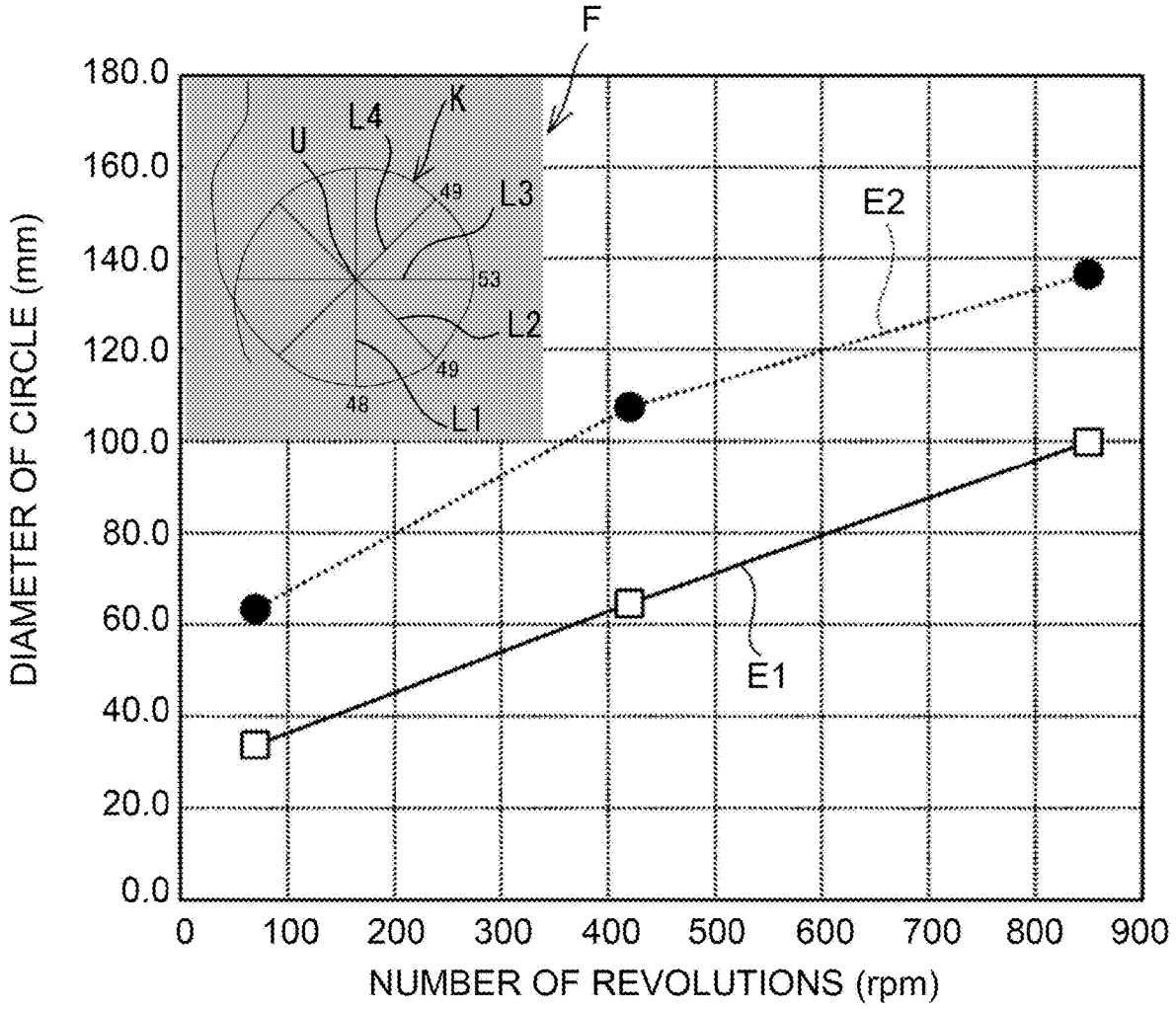
FIG. 10 is a graph showing results of an evaluation test regarding ease of changing an orientation of the workpiece relative to a needle plate during sewing in a case where the pressing device is used and in a case where the known pressing device is used.

Referring to FIG. 10, a description will be provided on results of an evaluation test regarding ease of changing an orientation of the workpiece C relative to the needle plate 3 during sewing in a case where the pressing device 9 according to the illustrative embodiment is used and in a case where the known pressing device 99 is used. In the evaluation test, as illustrated in a photograph F of FIG. 10, three evaluators each formed a circle K as small as possible on the workpiece C by forming stitches counterclockwise in plan view using the pressing device 9 in one case and using the known pressing device 99 in the other case. Line segments L1, L2, L3, and L4 in each circle K indicate diameters, respectively, of the circle K that pass through the center U of the circle K and divide the circle K into eight equal parts. In each circle K formed by a respective evaluator, an average of lengths of all the line segments L1, L2, L3, and L4 was assumed as a diameter of the circle K. An average was obtained from the diameters of the circles K formed by the respective evaluators and used as an evaluation value. A sewing machine "NextF7.4" manufactured by Brother Industries, Ltd. was used as the sewing machine 1, and sewing was performed at three different sewing speeds of 70 rpm, 420 rpm, and 850 rpm. The pressing force of the pressing spring 81 was about 15.7 N, and the urging force of the first urging member 4 was about 4.9 N. In a case where the pressing device 99 was used, the presser bar clamp 82 did not contact the contact portion 95 of the lever 90 during sewing, and pressure applied from the presser foot 5 to the workpiece C was almost constant. In a case where the known pressing device 9 is used, the presser bar clamp 82 contacts the contact portion 95 of the lever 90 during sewing, and the pressing force applied from the presser foot 5 to the workpiece C during the period P2 (refer to FIG. 9) is less than that during the period P1.

As illustrated in FIG. 10, it was confirmed that circles formed using the pressing device 9 indicated by a legend E1 has smaller diameters than circles formed using the known pressing device 99 indicated by a legend E2 in all cases where the sewing speed is 70 rpm, 420 rpm, and 850 rpm, respectively. In a case where the pressing device 9 is used and the second member 6 is located at the second position when the lower end of the needle 35 is located below the needle plate 3, less pressure was applied to the workpiece C when the needle 35 is penetrating the workpiece C than that when the workpiece C is being conveyed by the feed dog 19. Accordingly, it can be considered that in a case where the pressing device 9 is used, when the lower end of the needle 35 is located below the needle plate 3, the orientation of the workpiece C relative to the needle plate 3 is changed readily compared to a case where the known pressing device 99 is used. Nevertheless, it was confirmed that each stitch formed on the workpiece C has the same length in both the case where the pressing device 9 was used and the case where the known pressing device 99 was used. As described above, in the pressing device 9, the pressing force of the pressing spring 81 is transmitted to the presser foot 5 and the workpiece C as in the pressing device 9 when the workpiece C is being conveyed by the feed dog 19 (i.e., the period P1), and the pressing force less than that of the known pressing device 99 is applied to the presser foot 5 when the needle 35 is penetrating the workpiece C (i.e., the period P2). It was thus confirmed that such a control enables the evaluators to readily change the orientation of the workpiece C relative to the needle plate 3.

Figure 11:
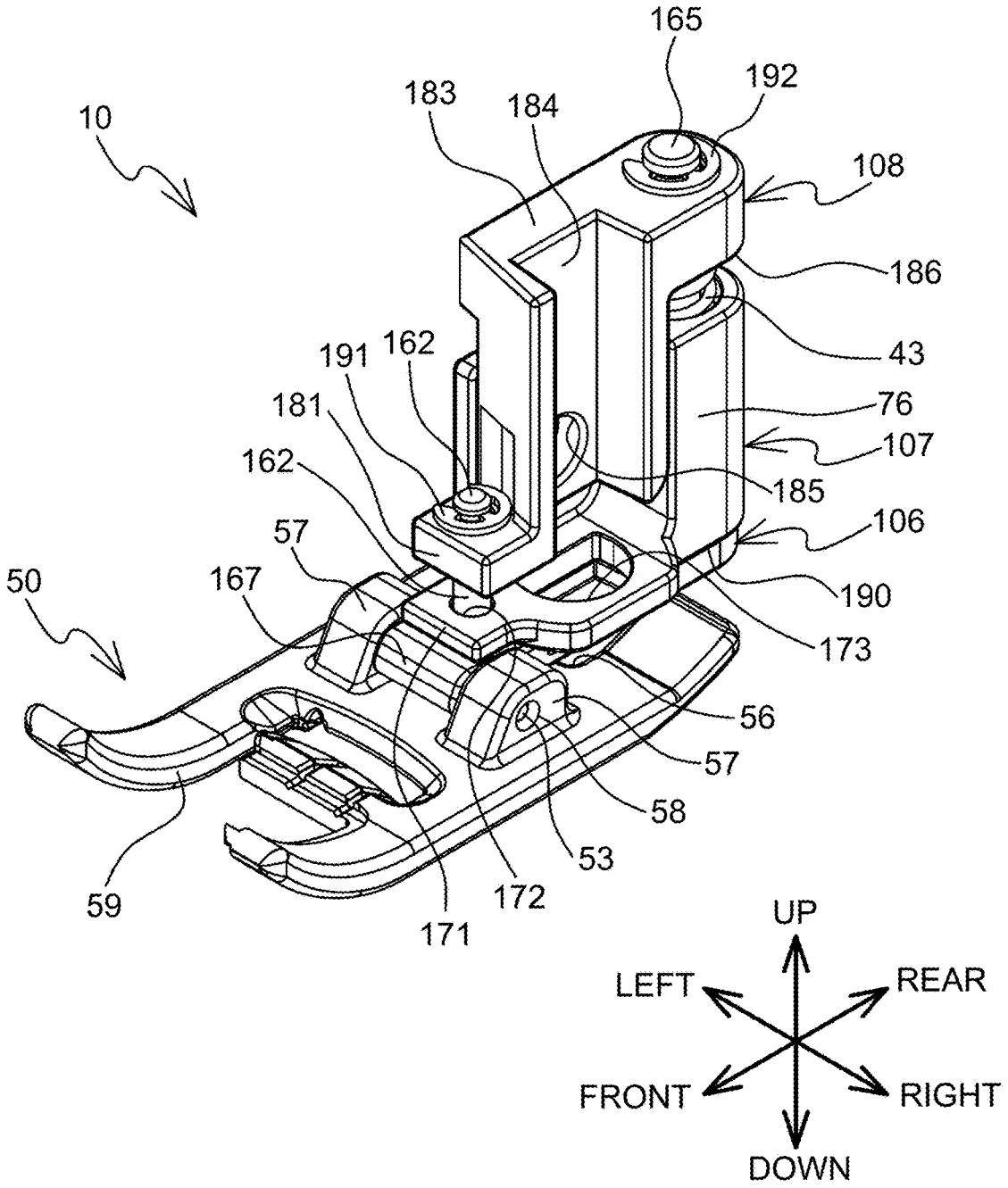
FIG. 11 is a perspective view of a pressing device and a presser foot attached to the pressing device according to a first modification.
Figure 12:
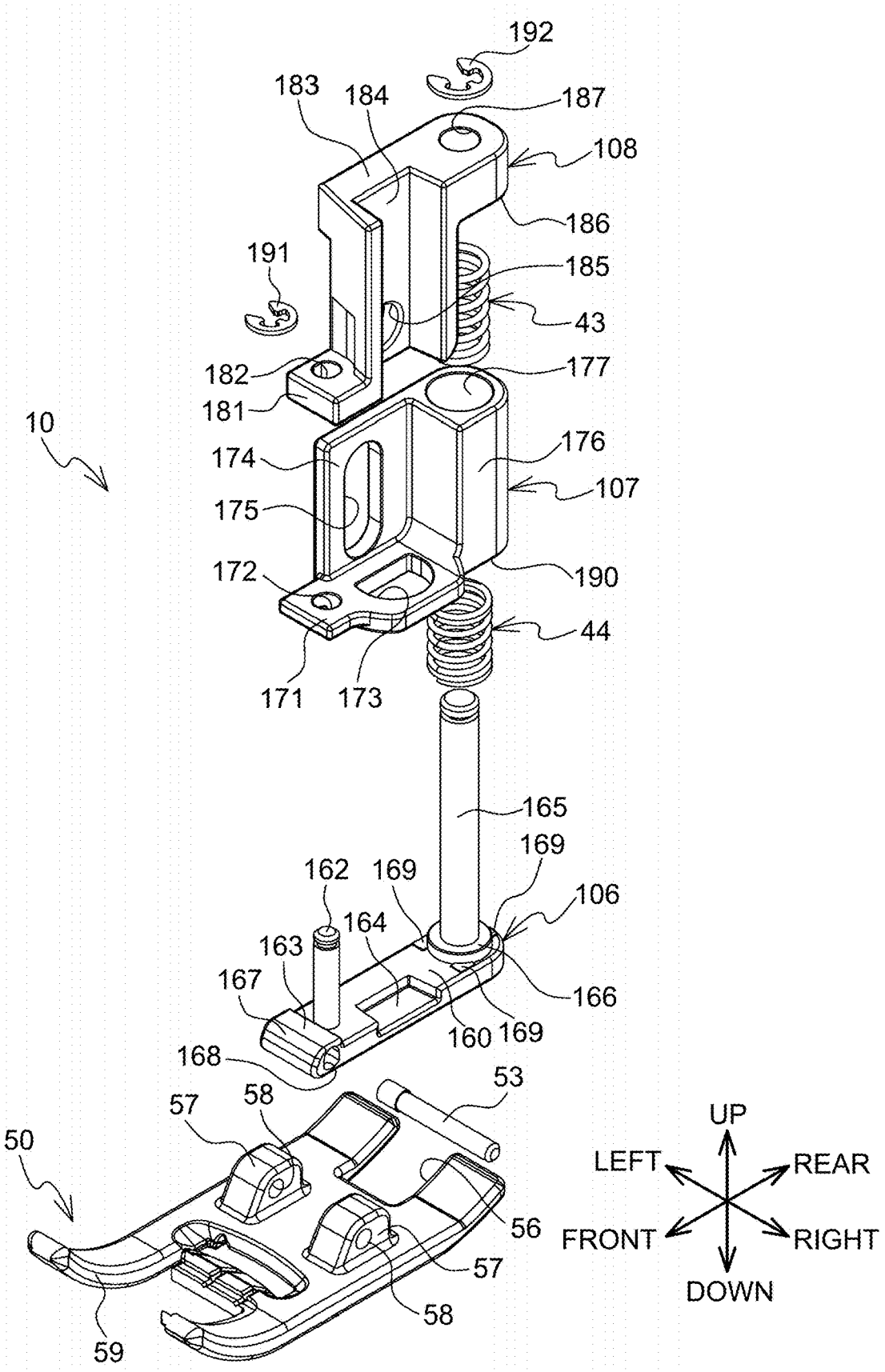
FIG. 12 is a disassembled perspective view of the pressing device and the presser foot attached to the pressing device according to the first modification.

Referring to FIGS. 11 to 15, and 16A and 16B, a description will be provided on a presser foot 50 and a pressing device 10 according to a first modification. In FIGS. 11 to 16B, common elements have the same reference numerals as those according to the illustrative embodiment, and a detailed description of the common elements will be omitted. As illustrated in FIGS. 11 and 12, the presser foot 50 is different from the presser foot 5 according to the illustrative embodiment in that the presser foot 50 includes a pair of shaft support portions 57 instead of the pair of shaft support portions 51, and other configurations are the same as those of the presser foot 5 according to the illustrative embodiment. The pair of shaft support portions 57 is shorter than the pair of shaft support portions 51 in the front-rear direction. Each of the shaft support portions 57 has a hole 58 extending therethrough in the left-right direction. The shaft 53 is inserted into the holes 58 and supported by the shaft support portions 57.

In the first modification, the pressing device 10 includes a first member 107, a second member 106, a third member 108, a guide portion 165, a first urging member 44, and a second urging member 43. The third member 108 includes a main body portion 183 and a front portion 181. The main body portion 183 has a C shape in plan view. The main body portion 183 has a recessed portion that is recessed toward the left from a right surface of the main body portion 183. The recessed portion of the main body portion 183 serves as an attaching portion 184. The main body portion 183 has a hole 185 in a left surface thereof. The hole 185 extends through the main body portion 183 in the left-right direction to communicate with the attaching portion 184. The hole 185 has a circular shape in right side view. The main body portion 183 has a second insertion portion 187 behind the attaching portion 184. The second insertion portion 187 extends through the main body portion 183 in the up-down direction. The main body portion 183 has a cutout portion 186 in its lower rear portion. The cutout portion 186 extends in the up-down direction. The front portion 181 protrudes toward the front from a lower front surface of the main body portion 183. The front portion 181 has an insertion portion 182 having a circular shape in plan view. The insertion portion 182 extends through the front portion 181 in the up-down direction.

The first member 107 includes a main body portion 176, a front portion 171, and a pressing portion 190. The main body portion 176 has a recessed portion that is recessed toward the left from a right surface of the main body portion 176. The recessed portion of the main body portion 176 serves as an attaching portion 174. The attaching portion 174 of the first member 107 has an elongated hole 175 for fastening the first member 107 to the lower end portion of the presser bar 8 with a screw 41 (refer to FIG. 8A). The elongated hole 175 is elongated in the up-down direction. The elongated hole 175 extends through the main body portion 176 to communicate with the attaching portion 174. The elongated hole 175 has an elongated length in the up-down direction greater than that of the hole 185 of the third member 108 in the up-down direction. The main body portion 176 has a first insertion portion 177 behind the attaching portion 174. The first insertion portion 177 extends through the main body portion 176 in the up-down direction. The front portion 171 may be a plate-like portion protruding toward the front from a lower front surface of the main body portion 176. The front portion 171 has an insertion portion 172 having a circular shape in plan view. The insertion portion 172 extends through the front portion 171 in the up-down direction. The main body portion 176 has a hole 173 penetrating a lower portion thereof in the up-down direction. The hole 173 is defined behind the insertion portion 172 and to the right of the elongated hole 175. At least a portion of the first member 107 and at least a portion of the presser bar 8 may serve as the pressing portion 190. In the first modification, a lower surface of the front portion 171 and a lower surface of the main body portion 176 serves as the pressing portion 190.

The second member 106 supports the presser foot 50 that may press downward the workpiece C placed on the bed 11 of the sewing machine 1. The second member 106 has a rectangular plate shape in plan view. The second member 106 includes a main body portion 160, a recessed portion 164, guide portions 162 and 165, a front portion 167, and contact portions 163, 166, and 169. The main body portion 160 has a rectangular plate shape having longer sides extending in the front-rear direction. The main body portion 160 has a dimension in the up-down direction shorter than a dimension of the first member 107 in the up-down direction. The recessed portion 164 are recessed downward at a middle portion of the main body portion 160 in the front-rear direction. The recessed portion 164 is defined in a right portion of the main body portion 160.

The guide portions 162 and 165 each have a rod-like shape and are fixed to the second member 6. The guide portions 162 and 165 guide movement of the second member 106 relative to the first member 107. The guide portion 162 is disposed in front of the recessed portion 164. The guide portion 162 has a cylindrical shape and extends upward from an upper surface of the main body portion 160. The guide portion 162 is inserted into the insertion portion 172 of the first member 107 and the insertion portion 182 of the third member 108. As illustrated in FIG. 11, the guide portion 162 extends through the front portion 171 of the first member 107 and the front portion 181 of the third member 108 in the up-down direction, and protrudes from an upper end of the front portion 181 of the third member 108. A retaining ring 191 is attached to an upper end portion of the guide portion 162. In a state where the guide portion 162 is inserted through the insertion portion 172 of the first member 107 and the insertion portion 182 of the third member 108, the front portion 181 of the third member 108 is disposed above the front portion 171 of the first member 107, and the front portion 167 of the second member 106 is disposed below the front portion 171 of the first member 107. Further, the attaching portion 184 of the third member 108 is disposed next to the attaching portion 174 of the first member 107 in the left-right direction, the hole 185 is disposed to the right of the elongated hole 175, and the second insertion portion 187 is disposed above the first insertion portion 177. In plan view, the hole 173 of the first member 107 and the recessed portion 164 of the second member 106 are disposed corresponding to the attaching portion 184.

Figure 13:
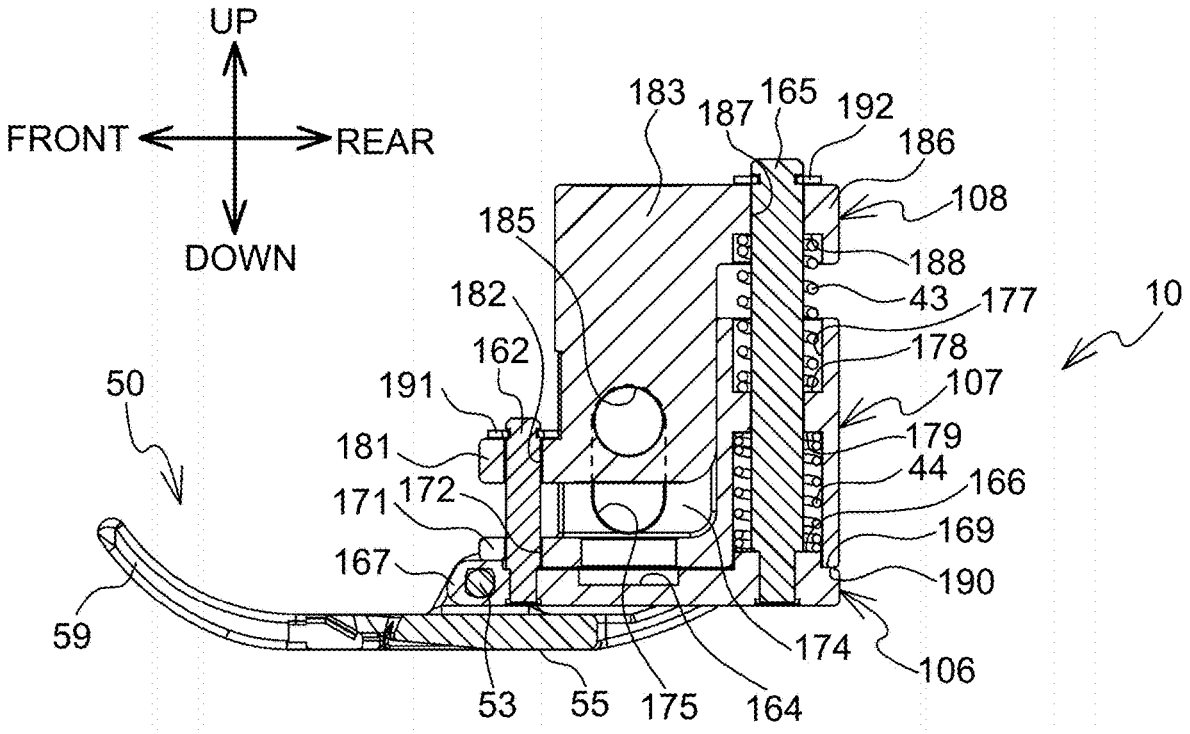
FIG. 13 is a sectional view of the pressing device and the presser foot attached to the pressing device in a state where a first member, a second member, and a third member are free from an external force according to the first modification.

As illustrated in FIG. 12, the guide portion 165 is disposed behind the recessed portion 164. The guide portion 165 has a cylindrical shape and extends upward from the upper surface of the main body portion 160. The guide portion 165 has a dimension in the up-down direction greater than a dimension of the main body portion 176 of the first member 107 in the up-down direction. The guide portion 165 is inserted into the first insertion portion 177 of the first member 107 with the first urging member 44 being disposed around the guide portion 165. That is, the first urging member 44 is disposed outside the guide portion 165. The first urging member 44 may be, for example, a coil spring. The guide portion 165 extends through the first member 107 in the up-down direction. As illustrated in FIG. 13, the first insertion portion 177 has a contact portion 179. An upper end of the first urging member 44 is in contact with the contact portion 179 of the first insertion portion 177. A lower end of the first urging member 44 is in contact with an upper surface of the contact portion 166 of the second member 106. In a state where the first member 107 is attached to the presser bar 8 of the sewing machine 1, the first urging member 44 urges the second member 106 downward with an urging force less than a pressing force from the presser bar 8. The guide portion 165 is inserted into the first insertion portion 177 of the first member 107, thereby limiting the movement of the second member 6 in the direction intersecting the up-down direction.

The guide portion 165 is inserted into the second insertion portion 187 of the third member 108 with the second urging member 43 being further disposed around the guide portion 165. That is, the second urging member 43 is disposed outside the guide portion 165. The second urging member 43 may be, for example, a coil spring. The guide portion 165 extends through the third member 108 in the up-down direction and protrudes from an upper end of the third member 108. A retaining ring 192 is attached to an upper end portion of the guide portion 165. The retaining ring 191 defines a movable range of the first member 107 in the up-down direction relative to the second member 106. The retaining ring 192 defines a movable range of the third member 108 in the up-down direction relative to the second member 106. The second insertion portion 187 has a contact portion 188. The first insertion portion 177 has a contact portion 178. An upper end of the second urging member 43 is in contact with the contact portion 188 of the second insertion portion 187. A lower end of the second urging member 43 is in contact with the contact portion 178 of the first member 107. The second urging member 43 presses the first member 107 downward with a force greater than the urging force applied by the first urging member 44. The third member 108 is in contact with the upper end of the second urging member 43, and is attached to the presser bar 8 of the sewing machine 1 together with the first member 107. The guide portion 165 is inserted into the first insertion portion 177 of the first member 107, thereby limiting the movement of the first member 107 in the direction intersecting the up-down direction. The guide portion 165 is inserted into the second insertion portion 187 of the third member 108, thereby limiting the movement of the third member 108 in the direction intersecting the up-down direction.

The front portion 167 protrudes toward the front from a front surface of the main body portion 160. The front portion 167 has a hole 168 extending therethrough in the left-right direction. In a state where the presser foot 50 is attached to the second member 106, the front portion 167 of the second member 106 is placed between the shaft support portions 57 of the presser foot 50 in the left-right direction and the shaft 53 is inserted through the hole 168 of the front portion 167. The presser foot 50 is thus supported by the second member 106 so as to be swingable about the shaft 53. An upper surface of the front portion 167 serves as the contact portion 163. The contact portion 163 is disposed higher than the upper surface of the main body portion 160 in the up-down direction. The contact portion 166 has a ring shape surrounding a lower end portion of the guide portion 165. An upper end of the contact portion 166 is disposed higher than the upper surface of the main body portion 160 in the up-down direction. The contact portion 166 is in contact with the lower end of the first urging member 44 and is inserted into the first insertion portion 177. The three contact portions 169 are disposed behind the recessed portion 164 and around the circular contact portion 166. The contact portions 169 may be projecting portions that protrude upward from the upper surface of the main body portion 160. One of the contact portions 169 is disposed in front of and to the right of the guide portion 165. Another of the contact portions 169 is disposed in front of and to the left of the guide portion 165. The other of the contact portions 169 is disposed behind the guide portion 165. The contact portion 163 and the three contact portions 169 are in contact with the pressing portion 190 when the second member 106 is located at the first position.

Figure 14:
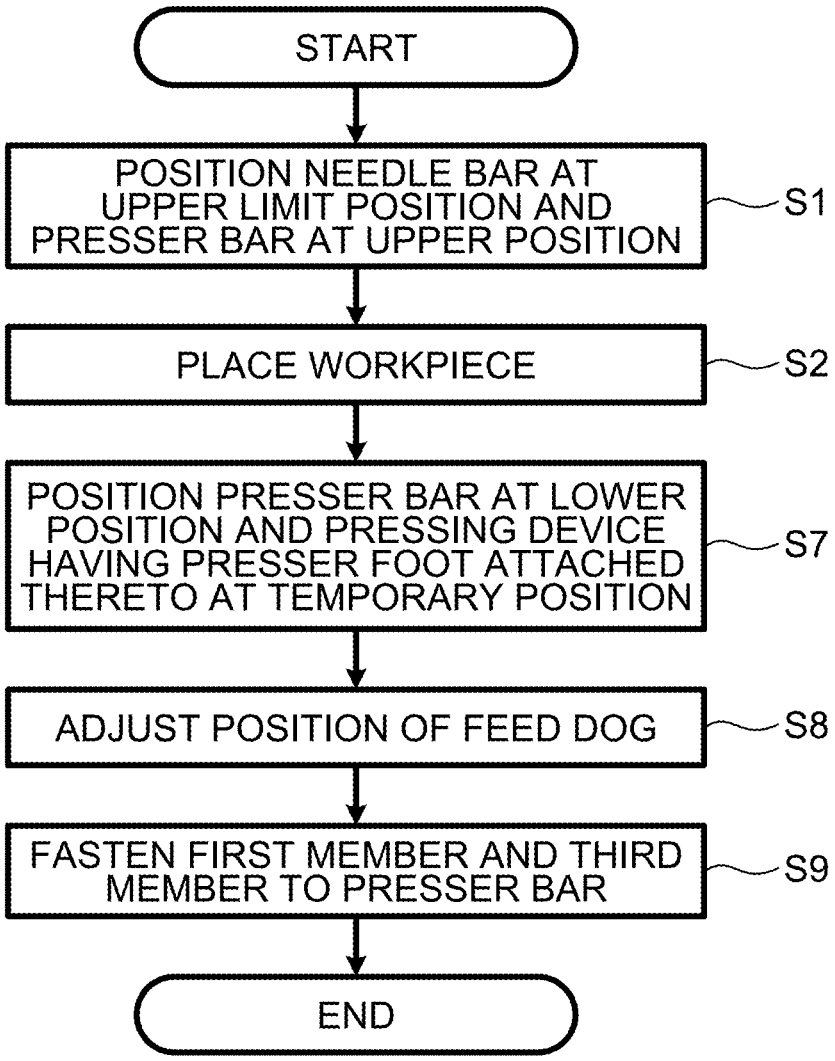
FIG. 14 is a flowchart illustrating a procedure for attaching the pressing device according to the first modification to the lower end of the presser bar.

Referring to FIG. 14, a description will be provided on a procedure of attaching the pressing device 10 to the presser bar 8 according to the first modification. In FIG. 14, common steps have the same step numbers as those of the procedure for attaching the pressing device 9 to the presser bar 8 illustrated in FIG. 7. The procedure for attaching the pressing device 10 to the presser bar 8 according to the first modification includes S7 and S8 instead of S3 and S4, and S9 instead of S5 and S6, and the other steps are the same as the steps of the attaching procedure according to the illustrative embodiment. Therefore, a detailed description of the common elements will be omitted, and a description will be provided on S7 to S9.

Subsequent to S2, the user operates the lever 90 to position the presser bar 8 at the lower position and the pressing device 10 having the presser foot 50 attached thereto at a temporary position relative to the presser bar 8 (S7). Specifically, for example, the user temporarily fixes the pressing device 10 to the lower end portion of the presser bar 8 in such a manner that the user positions the lower end portion of the presser bar 8 at the attaching portions 174 and 184 and then inserts a screw 41 into the hole 185 of the third member 108, the elongated hole 175 of the first member 107, and the threaded hole 84 of the presser bar 8. Subsequent to S7, the user adjusts the upper end of the feed dog 19 to a certain position (S8). The certain position where the upper end of the feed dog 19 is positioned in S8 is different from the certain position in S4. The certain position in S8 may be the position of the upper end of the feed dog 19 at the boundary between the period P1 and the period P2.

Figure 15A:
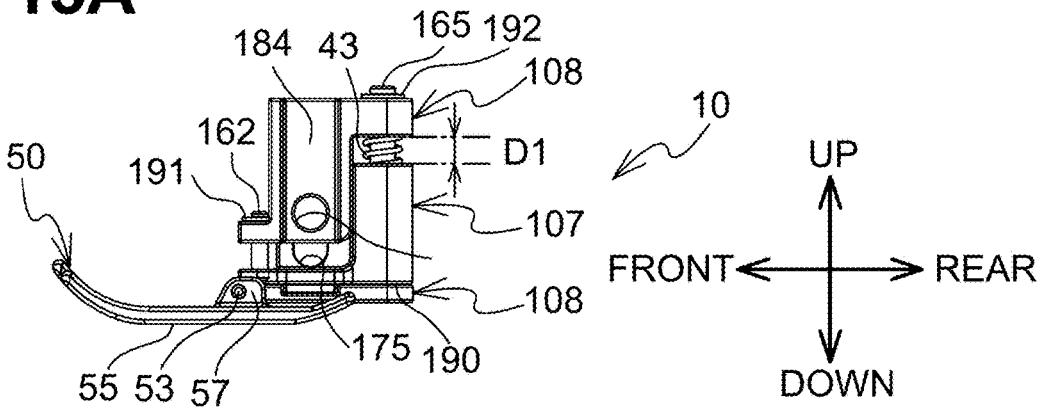
FIG. 15A is a right side view of the pressing device to which the presser foot is attached in a case where the third member is fixed to the presser bar at a reference position.
Figure 15B:
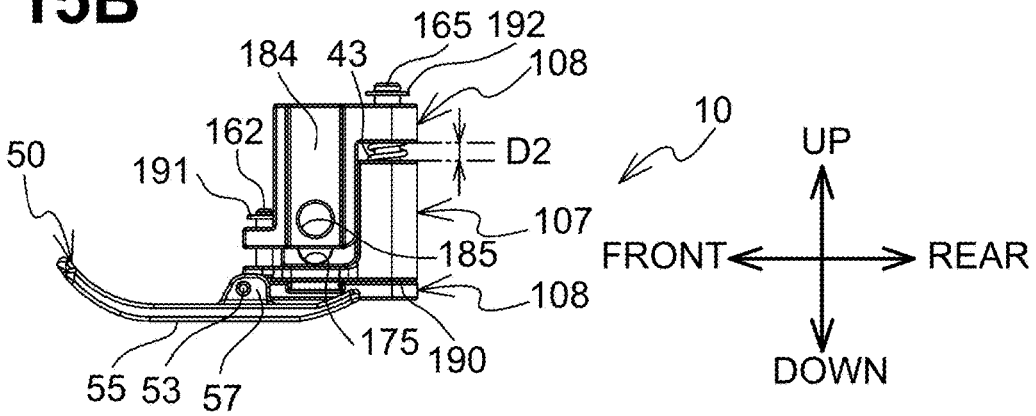
FIG. 15B is a right side view of the pressing device to which the presser foot is attached when a case where in the third member is fixed to the presser bar at a position 1 mm below the reference position.
Figure 15C:
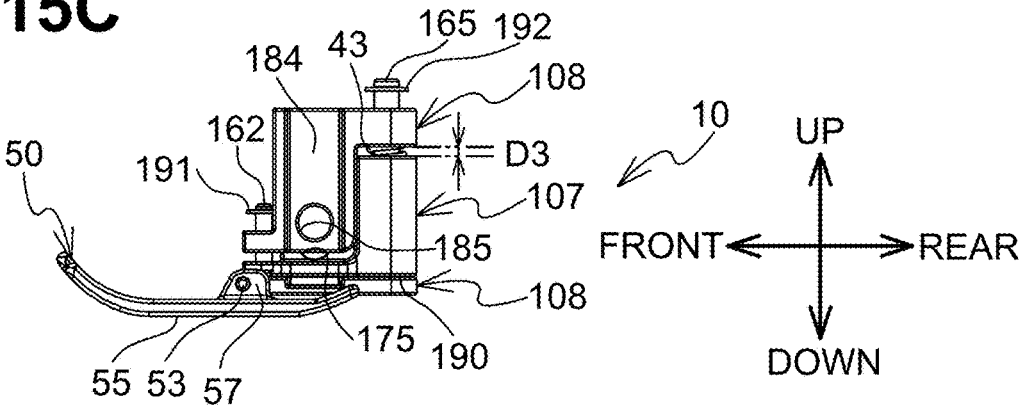
FIG. 15C is a right side view of the pressing device to which the presser foot is attached in a case where the third member is fixed to the presser bar at a position 2 mm below the reference position.
Figure 15D:
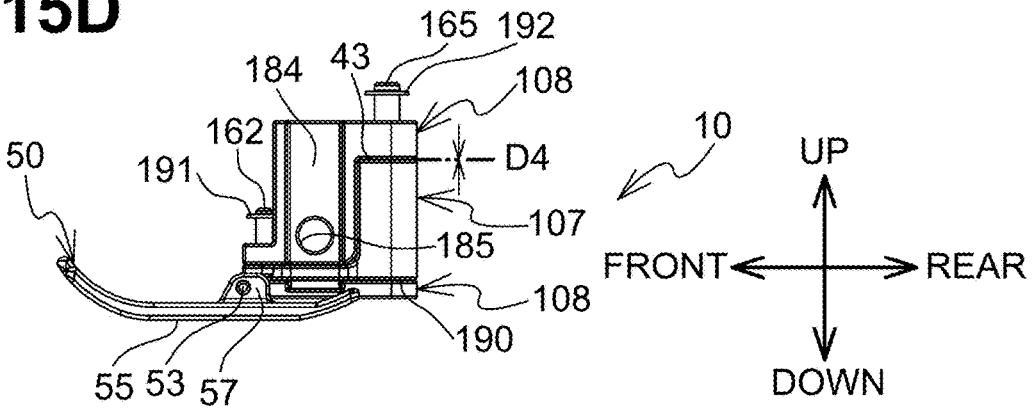
FIG. 15D is a right side view of the pressing device to which the presser foot is attached in a case where the third member is fixed to the presser bar at a position 3 mm below the reference position.

The urging force of the second urging member 43 is less than the urging force of the pressing spring 81 and sufficiently larger than the urging force of the first urging member 44. Thus, as illustrated in FIG. 15A, in a state where the first member 107, the second member 106, and the third member 108 are free from an external force (e.g., a reference state), the pressing portion 190 of the first member 107 is in contact with the second member 106. In other words, the reference state refers to a state where the third member 108 is free from a user operation. The position of the third member 108 in this state refers to a reference position of the third member 108. FIG. 15B illustrates a state where the third member 108 is located at a position 1 mm below from the reference position by a user operation. FIG. 15C illustrates a state where the third member 108 is located at a position 2 mm below from the reference position by a user operation. FIG. 15D illustrates a state where the third member 108 is located at a position 3 mm below from the reference position by a user operation. As illustrated in FIG. 15A, a distance D10 between an upper end of the cutout portion 186 of the third member 108 and the upper end of the main body portion 176 of the first member 107 is 3 mm. As illustrated in FIG. 15B, a distance D2 between the upper end of the cutout portion 186 of the third member 108 and the upper end of the main body portion 176 of the first member 107 is 2 mm. As illustrated in FIG. 15C, a distance D3 between the upper end of the cutout portion 186 of the third member 108 and the upper end of the main body portion 176 of the first member 107 is 1 mm. As illustrated in FIG. 15D, a distance D4 between the upper end of the cutout portion 186 of the third member 108 and the upper end of the main body portion 176 of the first member 107 is less than 1 mm, and the upper end of the cutout portion 186 of the third member 108 and the upper end of the main body portion 176 of the first member 107 are slightly spaced from each other in the up-down direction. The up-down position of the first member 107 relative to the third member 108 and the presser bar 8 is determined in accordance with a thickness of the workpiece C. In a state where the upper end of the feed dog 19 is located at the certain position by adjustment performed in S8, the user fastens the first member 107 and the third member 108 of the pressing device 9 to the lower end portion of the presser bar 8 using the screw 41 through the threaded hole 84 of the presser bar 8 (S9). As described above, the first member 107 and the third member 108 are fastened to the lower end of the presser bar 8 using the screw 41. Thus, the urging force of the second urging member 43 is not likely to affect the urging force of the first urging member 44. Upon completion of S9, the user completes the procedure of attaching the pressing device 10 to the presser bar 8.

Figure 16A:
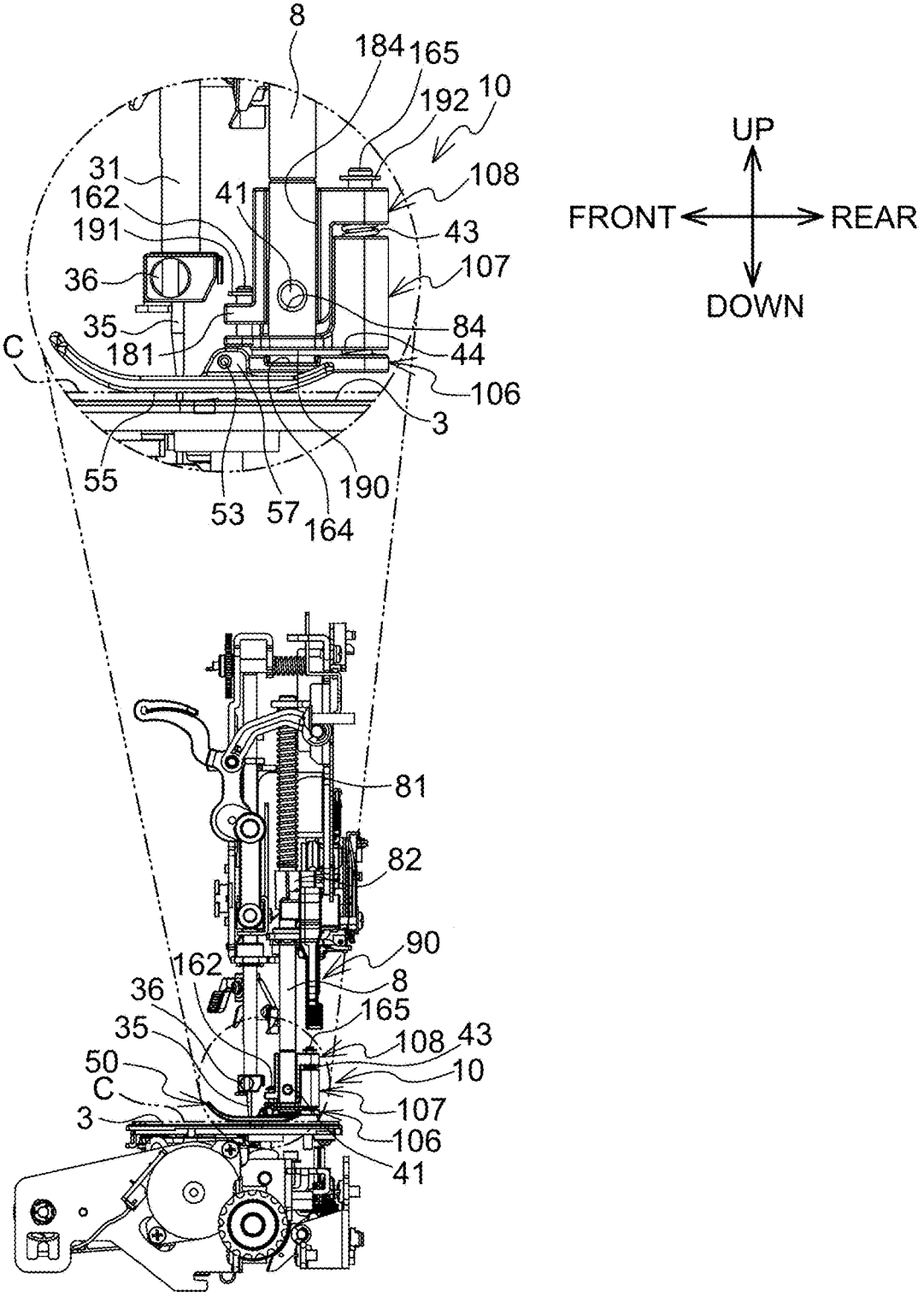
FIG. 16A is a right side view of the pressing device in which a needle is penetrating the workpiece having a thickness of 1 mm in a case where the third member is fixed to the presser bar at a position 2 mm below the reference position.
Figure 16B:
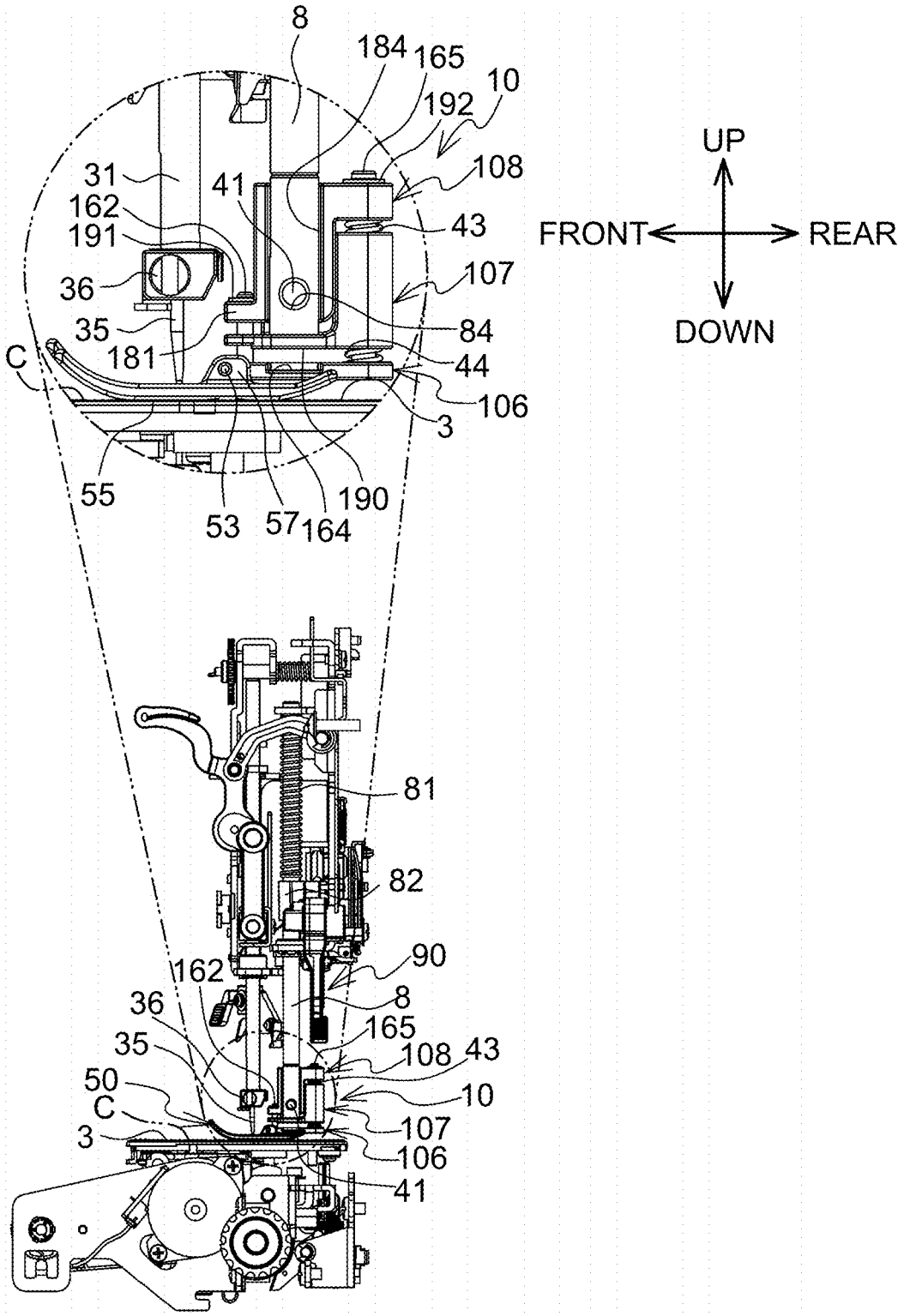
FIG. 16B is a right side view of the pressing device in which the needle is penetrating the workpiece having a thickness of 0.1 mm when the third member is fixed to the presser bar at a position 2 mm below the reference position.

In a case where a portion having a thickness of 1 mm in the workpiece C is sewn in a state where the third member 108 is fixed to the presser bar 8 at a position 2 mm below the reference position, as illustrated in FIG. 16A, the presser bar clamp 82 is in contact with the contact portion 95 of the lever 90 at a position where the needle 35 penetrates the workpiece C in the period P2. The second member 106 is moved downward by the urging force of the first urging member 44 from the first position to the second position that is lower than the first position where the upper surface of the second member 106 contacts the pressing portion 190. In a case where a portion having a thickness of 0.1 mm in the workpiece C is sewn, as illustrated in FIG. 16B, the second member 106 is located at a position lower than the position of FIG. 16A at the position where the needle 35 penetrates the workpiece C. That is, in the pressing device 10 according to the first modification, the pressing force to be applied to the workpiece C in the period P2 in a case where a thickness of the workpiece C changes during sewing may be adjusted by adjusting the up-down position of the first member 107 relative to the third member 108 and the presser bar 8 when the pressing device 10 is attached thereto.

Referring to FIGS. 17A to 17D, a description will be provided on a pressing device 109 and a lever mechanism 130 of a sewing machine 1 according to a second modification. In FIGS. 17A to 17D, common elements have the same reference numerals as those according to the illustrative embodiment, and a detailed description of the common elements will be omitted. The pressing device 109 includes a first member 207 instead of the first member 7. The pressing device 109 has a hole having a circular shape in right side view instead of the elongated hole 74 of the main body portion 75 of the first member 7, and the other configurations are the same as those of the above-described embodiment. That is, in the pressing device 109, the user is not allowed to adjust the attaching position of the first member 207 in the up-down direction relative to the presser bar 8.

Figure 17A:
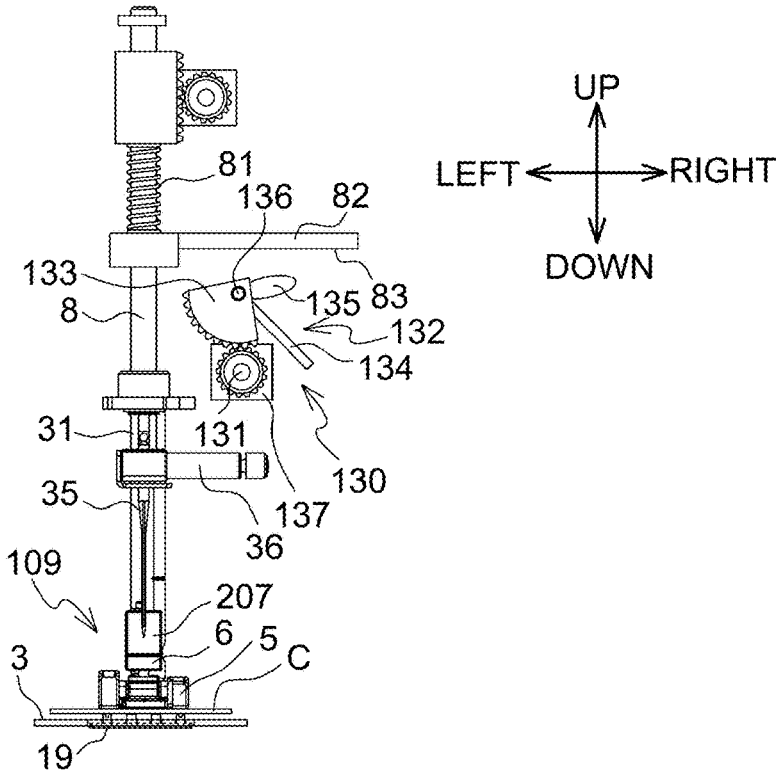
FIG. 17A is an explanatory view illustrating a state where a pressing device according to a second modification is attached to the presser bar.

According to the second modification, the sewing machine 1 includes a lever mechanism 130 instead of the lever 90, and the other configurations are the same as those of the sewing machine 1 according to the illustrative embodiment. As illustrated in FIG. 17A, the lever mechanism 130 includes a gear 131, a lever 132, and a motor 137. The lever 132 includes a sector-shaped gear 133, a shaft 136, a cam 135, and an operation portion 134. The gear 131 is fixed to an output shaft of the motor 137 and is rotated by the power of the motor 137. The motor 137 may be, for example, a pulse motor. The sector-shaped gear 133 is rotatably fixed by the shaft 136 and in mesh with the gear 131. The cam 135 is fixed to a side opposite to the sector-shaped gear 133 with respect to the shaft 136.

The operation portion 134 is disposed between the sector-shaped gear 133 and the cam 135, and has a rod-like shape extending downwardly toward the right from the shaft 136. The user is enabled to change the position of the presser bar 8 between the upper position and the lower position by rotating the operation portion 134 clockwise or counter-clockwise in plan view about the shaft 136. The operation portion 134 may adjust the up-down position where the presser bar clamp 82 and the lever mechanism 130 come into contact with each other when the presser bar 8 is located at the lowered position by rotating in clockwise or counter-clockwise in front view about the shaft 136. According to the second modification, in the sewing machine 1, the position of the presser bar 8 may be changed between the upper position and the lower position by rotating the gear 131 with the power of the motor 137 to pivot the sector-shaped gear 133 clockwise or counterclockwise about the shaft 136 in front view. According to the second modification, in the sewing machine 1, the up-down position where the presser bar clamp 82 and the lever mechanism 130 come into contact with each other when the presser bar 8 is located at the lowered position may be adjusted by rotation of the gear 131 by power of the motor 137.

Figure 17B:
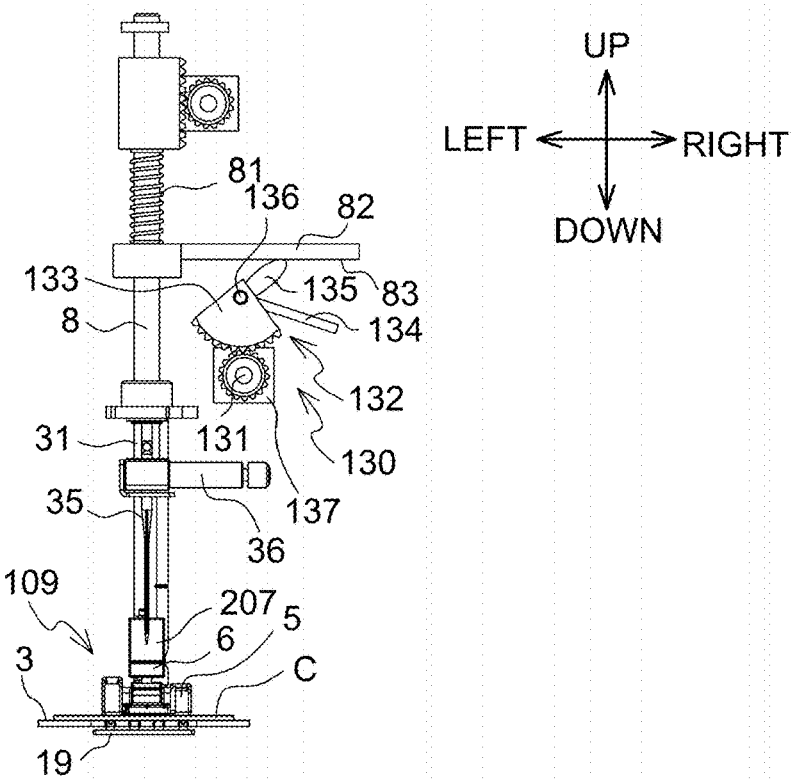
FIG. 17B is an explanatory view illustrating an operation of adjusting a position at which the presser bar clamp and a cam contact with each other in a state where the pressing device according to the second modification is attached to the presser bar.

Referring to FIGS. 17A to 17D, a description will be provided on a procedure of attaching the pressing device 109 to the presser bar 8. In the pressing device 109, the user is not allowed to adjust the attaching position of the first member 207 in the up-down direction relative to the presser bar 8. Thus, as illustrated in FIG. 17A, the position of the presser bar 8 in the up-down direction may be either the upper position or the lower position at the time of attaching the pressing device 109 to the presser bar 8. As illustrated FIG. 17B, after attaching the pressing device 109 to the presser bar 8, the user positions the feed dog 19 at a position where the upper end of the feed dog 19 is located below the upper surface of the needle plate 3, and positions the presser bar 8 at the lower position. In FIG. 17B, the upper end of the feed dog 19 is located below the upper surface of the needle plate 3 by the feed dog dropping mechanism while the needle bar 31 is located above the needle plate 3. In this state, the user drives the motor 137 or operates the operation portion 134 to contact the cam 135 and the presser bar clamp 82 each other to position the second member 6 at the second position. For contacting the cam 135 and the presser bar clamp 82 each other by driving the motor 137, in one example, the motor 137 may be controlled by the user. In another example, a sensor that detects a height of the presser bar clamp 82 may be provided. In this case, a controller of the sewing machine 1 may automatically control the motor 137 based on a detection result of the height of the presser bar clamp 82.

Figure 17C:
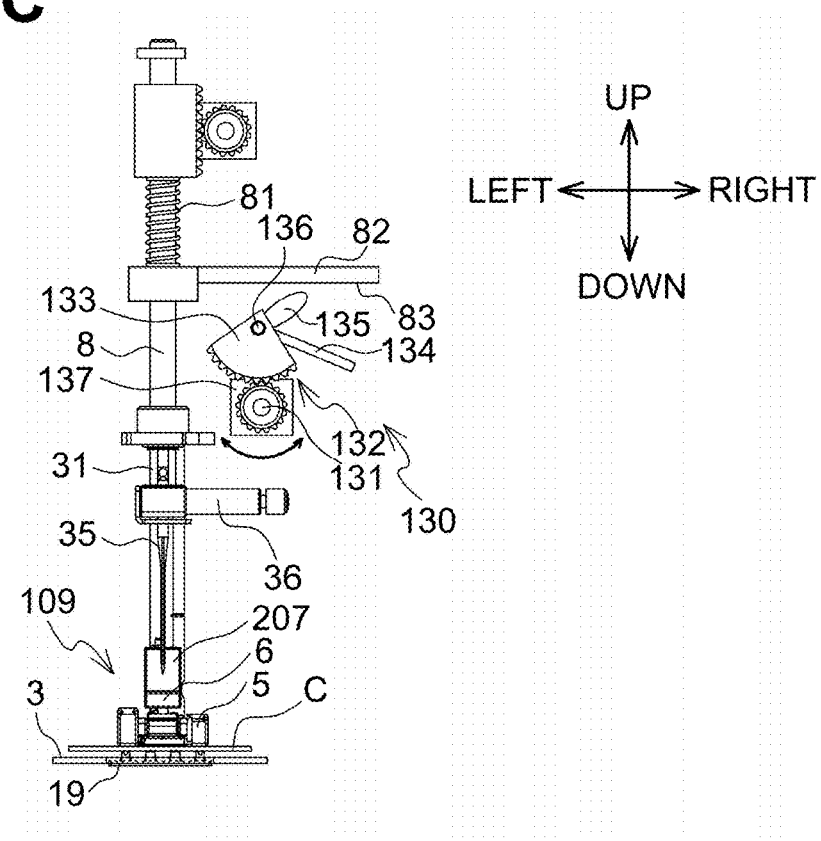
FIG. 17C is an explanatory diagram illustrating a state where an upper end of the feed dog is positioned above an upper surface of the needle plate after the position at which the presser bar clamp and the cam contact each other is adjusted.
Figure 17D:
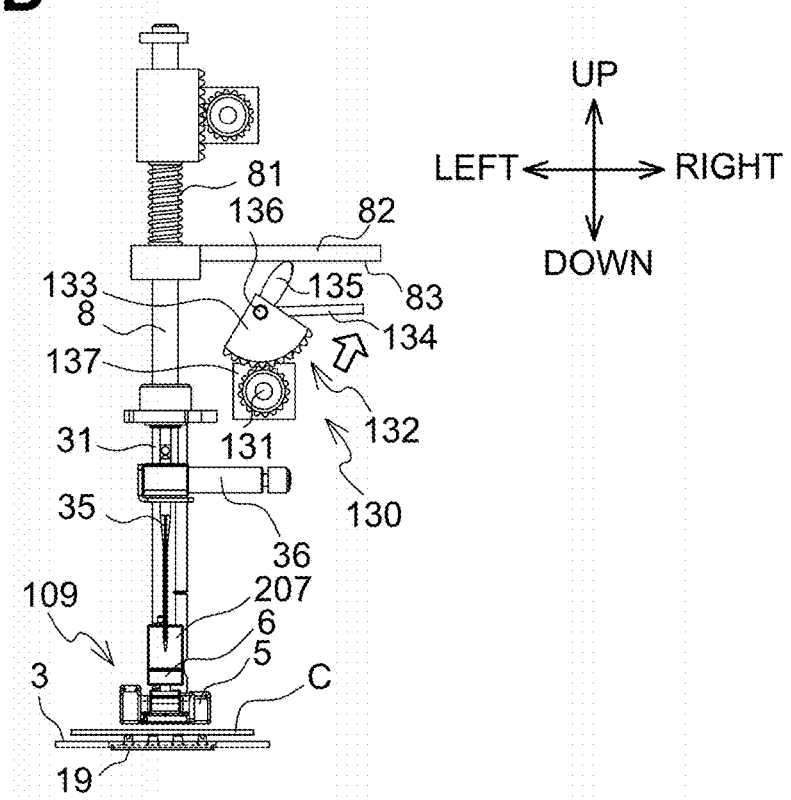
FIG. 17D is an explanatory view illustrating a state where the pressing device according to the second modification attached to the presser bar is located at an upper position.

In the case where the pressing device 109 is attached to the presser bar 8 by the above-described attaching procedure, in response to the upper end of the feed dog 19 moving to above the upper surface of the needle plate 3, the presser bar 8 is raised by the feed dog 19 via the presser foot 5 and the pressing device 109 in accordance with a raised amount of the feed dog 19 as illustrated in FIG. 17C. Thus, the second member 6 moves to the first position, the cam 135 and the presser bar clamp 82 are separated from each other in the up-down direction, and the urging force of the pressing spring 81 is transmitted to the presser foot 5. If the user operates the operation portion 134 while the motor 137 is energized, it may be hard to operate the lever 132. Thus, as illustrated in FIG. 17D, the sewing machine 1 preferably de-energizes the motor 137 at a timing at which the presser bar 8 is located at the upper position and sewing is not performed.

The sewing machine 1 according to the illustrative embodiment includes the machine motor 2, the needle bar 31, the needle plate 3, the presser bar 8, and the pressing device 9. The needle bar 31 is configured such that the needle 35 is attached to the lower end of the needle bar 31. The needle bar 31 is further configured to move in the up-down direction in response to driving of the machine motor 2. The needle plate 3 has the needle hole through which the needle 35 passes. The presser bar 8 is configured to move in the up-down direction in response to driving of the machine motor 2. The pressing device 9 is attached to the lower end portion of the presser bar 8. The pressing device 9 includes the first member 7, the second member 6, and the guide portion 67. The first member 7 includes the attaching portion 73 that is attached to the presser bar 8 of the sewing machine 1. The first member 7 is configured to move in the up-down direction together with the presser bar 8 being urged downward. The first member 7 supports the presser foot 5 that may press downward the workpiece C placed on the bed 11 of the sewing machine 1. The second member 6 includes the three contact portions 65 and the two contact portions 68, all of which is contactable to the pressing portion 80. In a case where the first member 7 is attached to the presser bar 8 of the sewing machine 1 and the second member 6 supports the presser foot 5, the second member 6 is movable between the first position and the second position. When the second member is located at the first position, the contact portions 65 and 68 of the second member 6 are in contact with the pressing portion 80. When the second member 6 is located at second position, the contact portions 65 and 68 of the second member 6 are spaced from the pressing portion 80. The guide portion 67 guides movement of the second member 6 relative to the first member 7. The sewing machine 1 including the pressing device 9 may change the change the position of the second member 6 relative to the first member 7. The pressing device 9 may eliminate need for a complicated mechanism, for example, a connecting member such as a link mechanism in the sewing machine 1, and may change the pressing force applied to the workpiece C by the presser foot 5 with a simpler configuration than the known configuration.

The pressing device 9 may be attached to the particular position of the presser bar 8 in the up-down direction. The particular position may be where the lower limit of the movable range of the presser bar 8 is defined by the lever 90 when the presser bar clamp 82 contacts the lever 90 while the needle bar 31 of the sewing machine 1 reciprocates once in the up-down direction. In this case, when the second member 6 is located at the first position, the second member 6 transmits, to the presser foot 5, the downward pressing force received from the presser bar 8 via the pressing portion 80. When the second member 6 is located at the second position, the second member 6 does not transmit the downward pressing force to the presser foot 5. In the pressing device 9, the transmission state of the downward pressing force from the presser bar 8 to the presser foot 5 supported by the second member 6 may be switched between the transmitting state and the non-transmitting state in accordance with the position of the second member 6 relative to the first member 7.

The pressing device 9 includes the first urging member 4 that urges the second member 6 downward with the urging force less than the pressing force from the presser bar 8 in a state where the first member 7 is attached to the presser bar 8 of the sewing machine 1. In a state where the first member 7 is attached to the presser bar 8 of the sewing machine 1 and the second member 6 is located at the second position, the second member 6 transmits the urging force of the first urging member 4 to the presser foot 5. The first urging member 4 of the pressing device 9 may press the workpiece C downward via the presser foot 5 also in a state where the second member 6 is located at the second position relative to the first member 7. When the second member 6 is located at the second position relative to the first member 7, the first urging member 4 of the pressing device 9 may press the workpiece C downward with a force less than that when the second member 6 is located at the first position relative to the first member 7. Thus, as confirmed by the evaluation test, the orientation of the workpiece C relative to the needle bar 31 may be changed readily.

The guide portion 67 has a rod-like shape and is fixed to the second member 6. The first member 7 includes the insertion portion 76 that is configured to limit the movement of the second member 6 in the direction intersecting the up-down direction by insertion of the guide portion 67 into the insertion portion 76. Such a configuration may thus enable the guide portion 67 to have a relatively simple configuration and the second member 6 to be stably moved in the up-down direction relative to the first member 7.

The guide portion 67 has a rod-like shape or a hollow cylindrical shape and is fixed to the second member 6. The first member 7 includes the insertion portion 76 that is configured to limit the movement of the second member 6 in the direction intersecting the up-down direction by insertion of the guide portion 67 into the insertion portion 76. The first urging member 4 may be a coil spring, and is disposed outside or inside of the guide portion 67. Such a configuration may thus enable the guide portion 67 and the first urging member 4 to have a relatively simple configuration and the second member 6 to be stably moved in the up-down direction relative to the first member 7.

The pressing device 9 includes the guide portion 67 and the guide portion 72 that are located on opposite sides of the attaching portion 73 in the direction intersecting the up-down direction in a state where the first member 7 is attached to the presser bar 8 of the sewing machine 1. The guide portion 72 is fixed to the first member 7. The guide portion 67 is fixed to the second member 6. The guide portions 67 and 72 of the pressing device 9 may enable the second member 6 to smoothly move in the up-down direction relative to the first member 7 compared to the pressing device 9 including a single guide portion, for example, the guide portion 67. Further, the guide portions 67 and 72 of the pressing device 9 may restrict the second member 6 from rotating about the guide portion 67 relative to the first member 7 compared to the pressing device 9 including a single guide portion 67.

In the first modification, the pressing device 10 includes the first member 107, the second member 106, the guide portions 162 and 165, the first urging member 44, the second urging member 43, and the third member 108. The second urging member 43 presses the first member 107 downward with the force greater than the urging force applied by the first urging member 44.

The third member 108 is in contact with the upper end of the second urging member 43, and is attached to the presser bar 8 of the sewing machine 1 together with the first member 107. The third member 108 of the pressing device 10 according to the first modification may enable the user to readily adjust the position of the second member 106 relative to the first member 107 during attachment of the first member 107 to the presser bar 8.

The attaching portion 174 of the first member 107 according to the first modification has the elongated hole 175 through which the screw 41 passes for fastening the first member 107 to the lower end portion of the presser bar 8 with the screw 41. The elongated hole 175 is elongated in the up-down direction. The third member 108 has the hole 185 having a length in the up-down direction less than a length of the elongated hole 175. The screw 41 is inserted to pass through the hole 185. The third member 108 is moved downward relative to the first member 107, thereby positioning the pressing device 10 relative to the presser bar 8. The third member 108 of the pressing device 10 according to the first modification may enable the user to readily adjust the position of the second member 106 relative to the first member 107 compared to a case where the pressing device 10 is fixed to the presser bar 8 via the first member 107 only.

The guide portion 165 of the pressing device 10 according to the first modification has a rod-like shape and is fixed to the second member 106. The first member 107 includes the first insertion portion 177 that is configured to limit the movement of the second member 106 in the direction intersecting the up-down direction by insertion of the guide portion 165 into the first insertion portion 177. The first insertion portion 177 extends through the first member 107 in the up-down direction. The second urging member 43 presses the first member 7 downward with the force greater than the urging force applied by the first urging member 4. The third member 108 includes the second insertion portion 187 that is configured to limit the movement of the third member 108 in the direction intersecting the up-down direction by insertion of the guide portion 165 into the second insertion portion 187. The second insertion portion 187 extends through the third member 108 in the up-down direction. The third member 108 of the pressing device 10 according to the first modification may enable the user to readily adjust the position of the second member 106 relative to the first member 107 during attachment of the first member 107 to the presser bar 8. The first insertion portion 177 and the second insertion portion 187 of the pressing device 10 enables smooth movement of the third member 108 and the second member 106 in the up-down direction relative to the first member 107 with a relatively simple configuration.

The sewing machine 1 includes the cam 135, the pressing spring 81, and the presser bar clamp 82. The cam 135 is configured to change the position of the presser bar 8 in the up-down direction. The pressing spring 81 urges the presser bar 8 downward. The presser bar clamp 82 is fixed to the presser bar 8 and defines the position of the lower end of the pressing spring 81. When the lower end of the needle 35 is located below the needle plate 3, the presser bar clamp 82 is in contact with the cam 135, thereby not transmitting the urging force of the pressing spring 81 to the pressing device 10 (particularly, the second member 106). When the lower end of the needle 35 is located above the needle plate 3, the presser bar clamp 82 is spaced from the cam 135, thereby transmitting the urging force of the pressing spring 81 to the pressing device 10 (particularly, the second member 106). As described above, the transmission state of the urging force of the pressing spring 81 to the pressing device 10 (particularly, the second member 106) may be switched between the transmitting state and the non-transmitting state. When the lower end of the needle 35 is located below the needle plate 3 and the upper end of the feed dog 19 is located below the upper surface of the needle plate 3, the cam 135 and the presser bar clamp 82 of the sewing machine 1 enables the user to readily perform the operation of adjusting the orientation of the workpiece C relative to the needle bar 31.

In the sewing machine 1, the second member 6 is located at the second position when the lower end of the needle 35 is located below the needle plate 3, and the second member 6 is located at the first position when the lower end of the needle 35 is located above the needle plate 3. Thus, the pressing force applied to the presser foot 5 by the pressing device 9 may be changed between when the lower end of the needle 35 is located below the needle plate 3 and when the lower end of the needle 35 is located above the needle plate 3. In the sewing machine 1, the pressing force from the pressing device 9 may be applied to the presser foot 5 also when the lower end of the needle 35 is located below the needle plate 3.

The cam 135 of the sewing machine 1 according to the second modification is contactable to the presser bar clamp 82 and includes the lever 132. In the sewing machine 1 according to the second modification, the up-down position where the presser bar clamp 82 and the cam 135 are in contact with each other may be changed depending on conditions such as a thickness of the workpiece C. In the sewing machine 1, the timing of switching the transmission state whether to transmit the urging force of the pressing spring 81 to the presser foot 5 may be controlled by the lever 132.

According to the pressing device 9 of the illustrative embodiment, in a state where the second member 6 is located at the first position, the user of the pressing device 9 attaches the attaching portion 73 of the first member 7 to the presser bar 8 of the sewing machine 1 (S6). In the pressing device 9 attached to the presser bar 8 in accordance with the procedure for attaching the pressing device 9, the position of the second member 6 when the pressing device 9 is attached to the presser bar 8 may be adjusted to the first position. The pressing device 10 according to the first modification may also achieve the same effects as those achieved by the pressing device 9 according to the illustrative embodiment. In a state where the second member 6 is located at the position offset to the first position from the separated position where the contact portions 65 and 68 are located farthest from the pressing portion 80 in the up-down direction, the user of the pressing device 9 attaches the attaching portion 73 of the first member 7 to the presser bar 8 of the sewing machine 1 (S6). In the pressing device 9 attached to the presser bar 8 in accordance with the procedure for attaching the pressing device 9, the position of the second member 6 when the pressing device 9 is attached to the presser bar 8 may be adjusted to the position offset to the first position from the separated position.

The user attaches the attaching portion 73 of the first member 7 to the presser bar 8 of the sewing machine 1 in a state where the lower limit of the movable range of the presser bar 8 is defined by the lever 90 with which the presser bar clamp 82 connected to the presser bar 8 of the sewing machine 1 is in contact, the presser foot 5 attached to the pressing device 9 is in contact with the needle plate 3 of the sewing machine 1 or the workpiece C placed on the needle plate 3 of the sewing machine 1, and the second member 6 is located at the first position (S6). In the pressing device 9 attached to the presser bar 8 in accordance with the procedure for attaching the pressing device 9, when the presser bar 8 is raised by the feed dog 19, the second member 6 is located at the first position and transmits the downward pressing force received from the presser bar 8 via the pressing portion 80 to the presser foot 5. When the presser bar clamp 82 contacts the lever 90 of the sewing machine 1, the second member 6 is located at the second position. Thus, the second member 6 does not receive the pressing force from the presser bar 8 and does not transmit the pressing force to the presser foot 5. That is, in the pressing device 9 attached to the presser bar 8 in accordance with the procedure for attaching the pressing device 9, the pressing force applied to the workpiece C by the presser foot 5 may be changed by switching the transmission state whether to transmit the pressing force from the presser bar 8 to the presser foot 5. The pressing device 10 according to the first modification may also achieve the same effects as those achieved by the pressing device 9 according to the illustrative embodiment.

While the disclosure has been described in detail with reference to the specific embodiment thereof, this is merely an example, and various changes, arrangements and modifications may be made therein without departing from the spirit and scope of the disclosure.

The sewing machine 1 and the pressing devices 9, 10, 109 may have other configurations, respectively. For example, the sewing machine 1 may be an industrial sewing machine. Any member other than the lever 90 may serve as a member with which the presser bar clamp 82 comes into contact while the needle bar 31 of the sewing machine 1 reciprocates once in the up-down direction. The presser bar clamp 82 might not necessarily come into contact with a particular member such as the lever 90 of the sewing machine 1 while the needle bar 31 of the sewing machine 1 reciprocates once in the up-down direction. The fastening member for fastening the pressing device 9 to the presser bar 8 may be changed as appropriate, and may be, for example, a bolt and a nut as well as the screw 41.

Any portion may serve as the pressing portion 80 of the pressing device 9 as long as the portion includes at least a portion of the first member 7 or at least a portion of the presser bar 8 and capable of transmitting the pressing force received from the presser bar 8 to the second member 6. In one example, the pressing portion 80 may be the lower end of the presser bar 8. In another example, the pressing portion 80 may be both the lower end of the presser bar 8 and the lower surface of the first member 7. The configuration for supporting the presser foot 5 may be changed as appropriate, and may be, for example, a hook-shaped portion engageable with the shaft 53 as well as the front portion 60 having the hole 61 through which the shaft 53 is inserted. The pressing device 9 might not necessarily include the first urging member 4. In this case, when the second member 6 is located at the second position, the presser foot 5 may press the workpiece C downward by weights of the second member 6 and the presser foot 5. The first urging members 4 and 44 and the second urging member 43 may be members other than coil springs, such as plate springs. At least one of the first urging members 4 or 44 or at least the second urging member 43 may be disposed further to the front than the presser bar 8.

The pressing device 9 may include either the guide portion 67 or the guide portion 72 but not both. The guide portions 67 and 72 might not necessarily have a rod-like shape. In one example, both of the guide portions 67 and 72 may be fixed to the first member 7. In another example, both of the guide portions 67 and 72 may be fixed to the second member 6. The pressing device 9 may include only another rod-like member in addition to the guide portions 67 and 72. The guide portions 67 and 72 may have any configuration as long as the guide portions 67 and 72 guide the movement of the second member 6 relative to the first member 7. For example, the guide portions 67 and 72 may have a rail shape that is fixed to one of the first member 7 and the second member 6 and is engaged with the other of the first member 7 and the second member 6. The insertion portion 76, the first insertion portion 177, and the second insertion portion 187 may be cutouts extending along the up-down direction as well as holes extending through the first member 7, the first member 107, and the third member 108, respectively, in the up-down direction. The guide portion 67 may have a hollow cylindrical shape and may be fixed to the second member 6. The first urging member 4 may be a coil spring and be disposed inside the guide portion 67. The hole 185 of the third member 108 may have any shape in side view having an elongated length less than the elongated length of the elongated hole 175 of the first member 107 in the up-down direction, or equal to the elongated length of the elongated hole 175 of the first member 107 in the up-down direction. The third member 108 may be immovable relative to the first member 107.

What is claimed is:

1. A pressing device, comprising:

a first member including an attaching portion attachable to a presser bar of a sewing machine, the first member being configured to move in an up-down direction together with the presser bar being urged downward, the attaching portion being (i) a recessed portion recessed from a surface of the first member in a direction perpendicular to the up-down direction and (ii) configured so that the presser bar can be inserted into the recessed portion from the direction perpendicular to the up-down direction;

a second member including a contact portion being contactable to a pressing portion, the pressing portion including at least a portion of the first member or at least a portion of the presser bar, the second member being configured to:

support a presser foot capable of downwardly pressing a workpiece placed on a bed of the sewing machine; and in a state where the first member is attached to the presser bar of the sewing machine and the second member supports the presser foot, move between:

a first position where the contact portion is in contact with the pressing portion; and a second position where the contact portion is spaced from the pressing portion;

a first guide portion configured to guide movement of the second member relative to the first member; and a second guide portion having a rod-like shape extending in the up-down direction, wherein the first guide portion has a rod-like shape extending in the up-down direction, wherein the first guide portion is inserted into a coil spring, and wherein the second guide portion is not inserted into any coil spring.

2. The pressing device according to claim 1, wherein, in a state where the coil spring is attached to the presser bar of the sewing machine, the coil spring is configured to urge the second member downward, wherein the second member is further configured to, in a state where the first member is attached to the presser bar of the sewing machine and the second member is located at the second position, transmit the urging force received from coil spring to the presser foot.

3. The pressing device according to claim 1, wherein the first guide portion is fixed to the second member, wherein the first member has an insertion portion, and wherein the first guide portion is inserted into the insertion portion, thereby limiting movement of the second member in a direction intersecting the up-down direction.

4. The pressing device according to claim 2, wherein the first guide portion is fixed to the second member, wherein the first member has an insertion portion, and wherein the first guide portion is inserted into the insertion portion, thereby limiting movement of the second member in a direction intersecting the up-down direction.

5. The pressing device according to claim 2, further comprising: a second urging member configured to press the first member downward with a force greater than the urging force of the spring coil; and a third member being in contact with an upper end of the second urging member, the third member configured to be attached to the presser bar of the sewing machine together with the first member.

6. The pressing device according to claim 5, wherein the attaching portion of the first member has an elongated hole elongated in the up-down direction, the elongated hole configured such that a fastening member passes therethrough for fastening the first member to a lower end portion of the presser bar with the fastening member, wherein the third member has a hole having a length in the up-down direction less than a length of the elongated hole in the up-down direction, the hole configured such that the fastening member passes therethrough, and wherein the third member is configured to move downward relative to the first member, thereby positioning the pressing device relative to the presser bar.

7. The pressing device according to claim 6, wherein the first guide portion is fixed to the second member, wherein the first member has a first insertion portion extending through the first member in the up-down direction, wherein the first guide portion is inserted into the first insertion portion, thereby limiting movement of the second member in a direction intersecting the up-down direction, wherein the third member has a second insertion portion extending through the third member, and wherein the first guide portion is inserted into the second insertion portion, thereby limiting movement of the second member in the direction intersecting the up-down direction.

8. The pressing device according to claim 1, wherein the first guide portion and the second guide portion are disposed on opposite sides of the attaching portion in a direction intersecting the up-down direction in a state where the first member is attached to the presser bar of the sewing machine, and wherein the first guide portion is fixed to the second member and the second guide portion is fixed to the first member.

9. The pressing device according to claim 8, wherein the first member has a third insertion portion, wherein the second member has a fourth insertion portion, and wherein the first guide portion is inserted into the third insertion portion and the second guide portion is inserted into the fourth insertion portion, thereby limiting movement of the second member in the direction intersecting the up-down direction.

10. A sewing machine, comprising:

a machine motor;

a needle bar having a lower end to which a needle is attachable, the needle bar being configured to move in the up-down direction in response to driving of the machine motor;

a needle plate having a needle hole through which the needle passes;

a presser bar configured to move in the up-down direction in response to driving of the machine motor; and the pressing device according to claim 1, the pressing device being attachable to a lower end portion of the presser bar from a direction perpendicular to the up-down direction.

11. The sewing machine according to claim 10, further comprising:

a cam configured to change a position of the presser bar in the up-down direction;

a pressing spring urging the presser bar downward; and a presser bar clamp fixed to the presser bar and defining a position of a lower end of the presser spring, the presser bar clamp configured to:

when a lower end of the needle is located below the needle plate, be in contact with the cam, thereby not transmitting an urging force of the pressing spring to the second member; and when the lower end of the needle is located above the needle plate, be spaced from the cam, thereby transmitting the urging force of the pressing spring to the second member.

12. The sewing machine according to claim 11, wherein the second member is located at the second position when the lower end of the needle is located below the needle plate, and the second member is located at the first position when the lower end of the needle is located above the needle plate.

13. The sewing machine according to claim 11, wherein the cam is contactable to the presser bar clamp, and includes a lever.

14. A method for attaching the pressing device according to claim 1, comprising attaching the attaching portion of the first member to the presser bar of the sewing machine in a state where the second member is located at the first position.

15. The method according to claim 14, wherein the attaching the attaching portion of the first member to the presser bar of the sewing machine comprises attaching the attaching portion of the first member to the presser bar of the sewing machine in a state where:

a lower limit of a movable range of the presser bar is defined by a particular member of the sewing machine with which a presser bar clamp connected to the presser bar of the sewing machine is in contact;

the presser foot attached to the pressing device is in contact with a needle plate of the sewing machine or the workpiece placed on the needle plate of the sewing machine; and the second member is located at the first position.

16. A method for attaching the pressing device according to claim 1, comprising attaching the attaching portion of the first member to the presser bar of the sewing machine in a state where the second member is at a position that is closer to the first position than to a separated position where the contact portion is located farthest from the pressing portion in the up-down direction.

17. The pressing device according to claim 1, wherein the first member includes an elongated hole, the elongated hole extending through the first member in the direction perpendicular to the up-down direction to communicate with the attaching portion.

* * * * *